US007905188B2

(12) United States Patent
Miyoshi

(10) Patent No.: US 7,905,188 B2
(45) Date of Patent: Mar. 15, 2011

(54) THREADING DEVICE OF SEWING MACHINE

(75) Inventor: Takanao Miyoshi, Chofu (JP)

(73) Assignee: Juki Corporation, Chofu-shi, Tokyo (JP)

( * ) Notice: Subject to any disclaimer, the term of this patent is extended or adjusted under 35 U.S.C. 154(b) by 434 days.

(21) Appl. No.: 12/171,830

(22) Filed: Jul. 11, 2008

(65) Prior Publication Data

US 2009/0013912 A1 Jan. 15, 2009

(30) Foreign Application Priority Data

Jul. 13, 2007 (JP) ..... P. 2007-184444
Mar. 4, 2008 (JP) ..... P. 2008-053411

(51) Int. Cl.
*D05B 87/02* (2006.01)
*D05B 1/08* (2006.01)

(52) U.S. Cl. ..... 112/225; 223/99

(58) Field of Classification Search ..... 112/163, 112/225, 259, 302; 223/99, 102
See application file for complete search history.

(56) References Cited

U.S. PATENT DOCUMENTS 4,070,977 A * 1/1978 Yamamoto et al. ..... 112/259
5,333,560 A * 8/1994 Yoshida ..... 112/470.04
2003/0019410 A1* 1/2003 Sano et al. ..... 112/470.01

FOREIGN PATENT DOCUMENTS

JP 03-133483 6/1991
JP 10-137482 5/1998
JP 02006061398 A * 3/2006

* cited by examiner

*Primary Examiner* — Ismael Izaguirre
(74) *Attorney, Agent, or Firm* — Drinker Biddle & Reath LLP

(57) ABSTRACT

A threading device of a sewing machine having a plurality of needles is provided. The threading device is configured to insert a thread through an eye of any one of the needles. The threading device includes a threading hook which moves forward to enter the eye of one of the needles and moves backward to catch and insert the thread through the eye, a threading mechanism which moves the threading hook to insert the thread, a selecting portion operable to select, among the plurality of needles, a needle through which the thread is to be inserted, a positioning mechanism which moves the threading hook to a position corresponding to the needle selected by operating the selecting portion, and a selected needle indicating device which distinguishably indicates the needle with respect to which the threading hook has been positioned by operating the selecting portion.

7 Claims, 22 Drawing Sheets

THREADING DEVICE OF SEWING MACHINE

CROSS-REFERENCE TO RELATED APPLICATION(S)

The present application claims priority from Japanese Patent Application No. 2007-184444 filed on Jul. 13, 2007 and Japanese Patent Application No. 2008-053411 filed on Mar. 4, 2008, the entire contents of which are incorporated herein by reference.

FIELD OF INVENTION

The present invention relates to a threading device of a sewing machine which can insert a thread with respect to a plurality of needles, eyes of which being different in height.

DESCRIPTION OF RELATED ART

In a sewing machine including a plurality of needles, the respective needles have different heights of eyes and are disposed at a regular interval in a direction intersecting a cloth feeding direction. A related art threading device for inserting a thread through each of the needles has a configuration disclosed, for example, in JP 10-137482 A Publication. More specifically, a threading shaft having a lower end provided with a threading hook for inserting a thread into an eye of a needle is supported to enable a vertical motion and a rotating operation with respect to an oscillating base which is oscillatably supported on a sewing machine frame. The threading shaft is provided with a threading lever having a cam groove formed in an oblique direction and enabling an operation downward, a threading guide for determining a height of the threading hook in a threading operation, and a transverse switching cam for oscillating the oscillating base by a manual operation in relation to each other.

The threading hook catches an end of a thread on a tip of the threading shaft when the threading shaft is rotated in one direction to insert the thread through the eye of the needle, and the threading shaft is rotated in the other direction to slip out of the eye, thereby pulling the caught thread into the eye to implement a threading operation.

A pin to be engaged with the cam groove of the threading lever is protruded from the threading shaft, and furthermore, a guide pin for abutting on an abutting surface of the threading guide is provided in the middle of a downward motion. For this reason, when the threading shaft is moved downward by a downward moving operation of the threading lever, the guide pin abuts on the threading guide in the middle of the downward movement so that the downward movement of the threading shaft is blocked. When the threading lever is operated downward, furthermore, the threading shaft is rotated in the one direction with respect to the threading lever to move the threading hook forward by means of the pin to be engaged with the cam groove.

The (two) needles have different arrangements in the direction intersecting the cloth feeding direction and the eyes also have different heights. In the threading device, therefore, two abutting surfaces having different heights are provided on the threading guide and the oscillating base is oscillated by the manual operation of the transverse switching cam to change a position of the threading shaft so that the guide pin is caused to abut on one of the abutting surfaces to enable the threading hook to correspond to the height of the eye and the arrangement of each of the needles.

In another related art threading device disclosed in JP 06-49114 B2 Publication, a horizontal shaft is provided on a sewing machine frame close to a vertical moving path of a needle and a threading member having a threading hook on a lower end is supported to be rotatable and oscillatable around the horizontal shaft. There has been known a configuration in which the threading member is moved over an arcuate track in an oblique direction and the threading hook can be inserted into eyes corresponding to positions of two needles.

According to the related art threading devices described above, however, a needle with respect to which the threading shaft or the threading member is set cannot be visually checked reliably after a switching operation unless the threading lever or an operation knob is actually operated to carry out a threading operation. For this reason, general users of the sewing machine of this type at home cannot carry out the threading operation at ease so that it is necessary to previously execute the threading operation by way of trial, resulting in a reduction in a working efficiency.

In a sewing machine having a large number of needles (e.g., three or more needles), in particular, it is necessary to carry out a work for confirming the needle with respect to which the threading member is set.

SUMMARY OF THE INVENTION

It is an object of the present invention to provide a threading device for a sewing machine having a plurality of needles, the threading device being configured to allow a user to easily confirm a needle through which a thread is to be inserted.

According to a first aspect of the invention, there is provided a threading device of a sewing machine having a plurality of needles, the threading device being configured to insert a thread through an eye of any one of the needles.

The threading device includes: a threading hook which moves forward to enter the eye of one of the needles and moves backward to catch the thread and to insert the thread through the eye; a threading mechanism which moves the threading hook to insert the thread; a selecting portion operable to select, among the plurality of needles, a needle through which the thread is to be inserted; a positioning mechanism which moves the threading hook to a position corresponding to the needle selected by operating the selecting portion; and a selected needle indicating device which distinguishably indicates the needle with respect to which the threading hook has been positioned by operating the selecting portion.

According to a second aspect of the invention, the selected needle indicating device includes an indicator which moves together with the threading hook, wherein the selected needle indicating device indicates, in accordance with a position of the indicator, the needle with respect to which the threading hook has been positioned.

According to a third aspect of the invention, the selected needle indicating device includes: position detecting means for detecting a position of the threading hook; and display means for indicating the needle corresponding to the position detected by the position detecting means.

According to a fourth aspect of the invention, the selected needle indicating device emits light to indicate the needle with respect to which the threading hook has been positioned.

According to a fifth aspect of the invention, the selected needle indicating device indicates, at a front side portion of the sewing machine, the needle with respect to which the threading hook has been positioned.

According to a sixth aspect of the invention, the selecting portion is disposed on a rear side of an indicating position of the selected needle indicating device.

According to a seventh aspect of the invention, there is provided a threading device of a sewing machine having a plurality of needles arranged along a direction intersecting a cloth feeding direction, the threading device being configured to selectively insert a thread through an eye of one of the needles.

The threading device includes: a threading hook which is supported on a sewing machine arm so as to be rotatable around a vertical axis and movable along an axial direction of the vertical axis, wherein the threading hook is rotatable, at a downwardly moved position which is coincident with the eye of one of the needles, between a forwardly moved position toward which the threading hook enters the eye and a backwardly moved position toward which the threading hook catches and inserts the thread through the eye; a threading mechanism coupled to the threading hook to rotate the threading hook between the backwardly moved position and the forwardly moved position; a selecting portion operable from an outside of the sewing machine to select a needle through which the thread is to be inserted; a positioning mechanism coupled to the threading hook to move the threading hook, interlockingly with the selecting portion, in the direction along which the plurality of needles are arranged to a position corresponding to the selected needle; and a selected needle indicating device including an indicator which is disposed so as to be visible from the outside of the sewing machine, wherein the indicator is configured to interlock with a movement of the threading hook in the direction along which the plurality of needles are arranged.

According to the first aspect of the invention, in a state in which the threading hook is aligned with the corresponding position to the selected needle through the positioning mechanism in accordance with the operation of the selecting portion, the threading hook is rotated and moved forward through the threading mechanism so that the threading operation is executed.

At this time, if the threading hook is aligned in accordance with the operation of the selecting portion, the selected needle indicating device indicates the needle with which the threading hook is aligned so as to be distinguishable from the other needles.

Differently from the case in which the position of the threading hook is visually confirmed, accordingly, it is possible to accurately grasp the selected needle. Furthermore, it is not necessary to operate the threading hook in order to carry out the confirmation before the threading operation. Therefore, it is possible to eliminate a complicatedness of the confirming work.

Also in case of a sewing machine provided with more needles, moreover, it is possible to carry out the confirming work easily and accurately. Consequently, it is possible to properly correspond to a sewing machine having more needles.

"The position corresponding to the needle" is a position of the threading hook at which the threading hook can be inserted into the eye of the needle when the threading hook is moved forward.

According to the second aspect of the invention, the needle with respect to which the threading hook is positioned is indicated in accordance with the change in the position of the indicator which moves together with the threading hook. Therefore, it is not necessary to provide means for detecting the position of the threading shaft and means for displaying information about the position. Consequently, it is possible to confirm the selected needle with a simple structure.

According to the third aspect of the invention, the change in the position of the threading hook is detected and there is provided the display means for indicating the needle based on the detection. Therefore, a mechanical movable structure is not required and a durability can be enhanced without an influence of a deterioration such as an abrasion.

According to the fourth aspect of the invention, the needle with respect to which the threading shaft is positioned is indicated with a light emission. Therefore, the selected needle can be distinguished more accurately and immediately.

According to the fifth aspect of the invention, the needle with respect to which the threading hook is positioned is indicated on the front side portion of the sewing machine. Therefore, the needle to be selected for the execution of the threading work can be confirmed without moving from a place in which the sewing work is to be carried out or changing a posture to look into the place. Consequently, it is possible to enhance a workability of the threading work and to relieve a burden of an operator.

"The front side portion of the sewing machine" is a position to be a front face seen from a position in which the operator is present with respect to the sewing machine in the sewing work, for example, a surface on an upstream side in a feeding direction of a workpiece in a sewing machine frame or a housing cover of the sewing machine.

According to the sixth aspect of the invention, the selecting portion is disposed behind the indicating position of the selected needle indicating device. In the operation for selecting the needle to carry out the threading work, therefore, it is possible to avoid a problem that an arm of the operator to carry out the operation causes the indication of the selected needle positioned on the front side of the sewing machine to be shielded or seen with difficulty. Thus, the selection of the needle can be confirmed well and a selecting error can be avoided, and furthermore, a workability can be enhanced.

"The rear side the indicating position of the selected needle indicating device" implies a provision on a surface positioned at a downstream side in a cloth feeding direction from a surface over which the selection indication is carried out in the sewing machine frame or the housing cover of the sewing machine. Although it is more desirable to set a position to be a rear face seen from a position in which the operator is present with respect to the sewing machine in the sewing work, it is not restricted but an upper or side surface of the sewing machine frame or the housing cover of the sewing machine may be set.

Other aspects and advantages of the invention will be apparent from the following description, the drawings and the claims.

DETAILED DESCRIPTION

Figure 1:
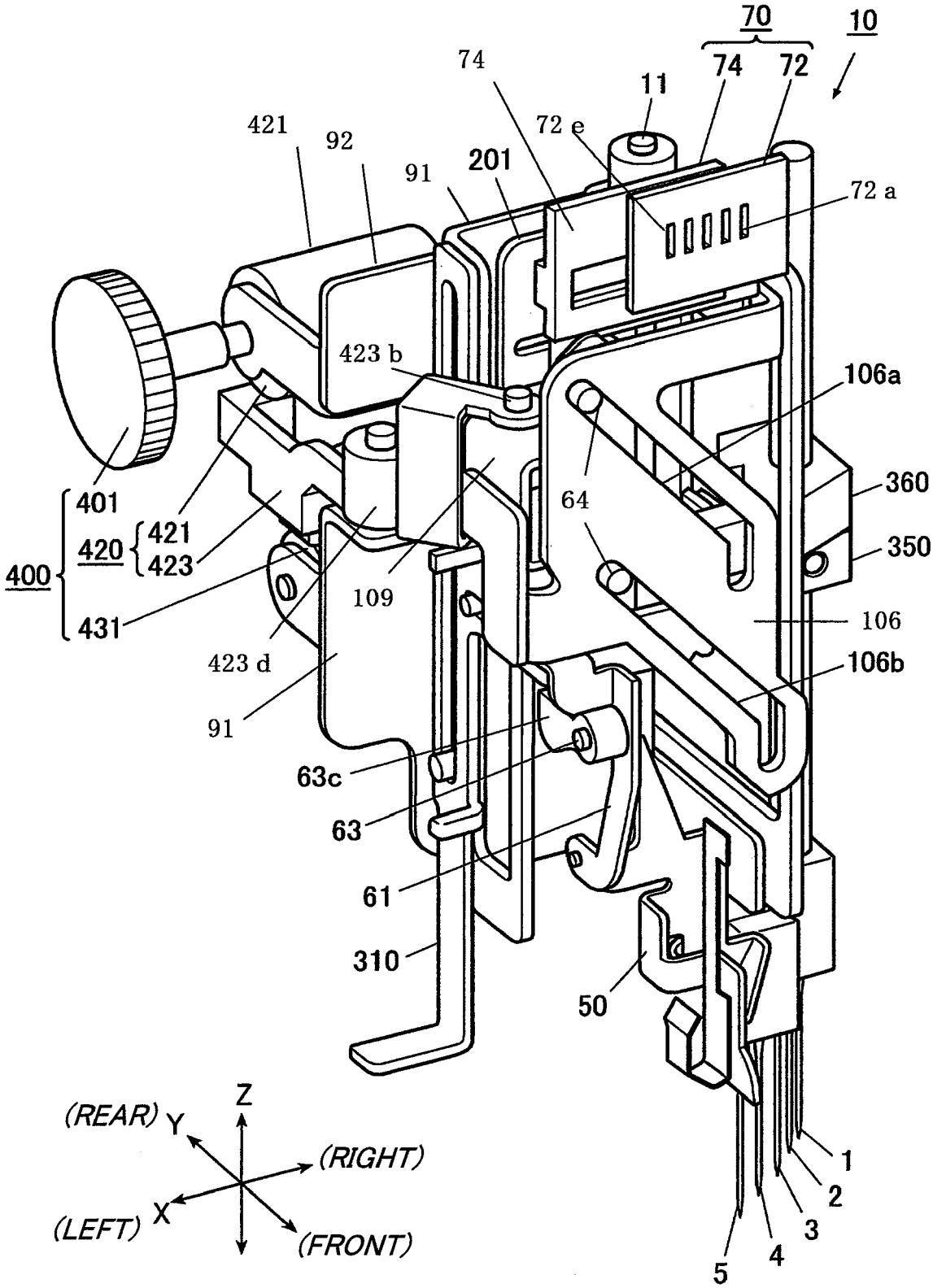
FIG. 1 is a perspective view of a threading device according to a first exemplary embodiment of the invention.

Hereinafter, exemplary embodiments of the invention will be explained with reference to the drawings. The following exemplary embodiments do not limit the scope of the invention. In the following description, a Z-axis direction is a vertical direction which is parallel to a needle bar 6, an X-axis direction (a first direction) is a direction intersecting a cloth feeding direction, and a Y-axis direction (a second direction) is a direction parallel to the cloth feeding direction.

First Exemplary Embodiment

A threading device 10 of a sewing machine according to a first exemplary embodiment will be described with reference to FIGS. 1 to 18.

The sewing machine mounting the threading device 10 thereon can selectively implement an overlock stitch and a cover stitch and has the needle bar 6 capable of attaching five needles 1-5. Two needles 1 and 2 are used for the overlock stitch and three needles 3, 4 and 5 are used for the cover stitch. The needles 1, 2 of a first group and the needles 3, 4, 5 of a second group are parallel with the first direction respectively and are disposed with an offset in a second direction.

The threading device 10 is disposed in an arm portion of the sewing machine adjacently to the needle bar 6.

The threading device 10 includes a threading shaft 11 for holding a threading hook 20 to insert, through eyes of the needles 1-5, a thread entering the eyes of the needles by a forward movement and caught by a backward movement, a threading mechanism 300 for giving a back and forth movement to the threading hook 20 through the threading shaft 11, a thread holding member 50 for holding the thread in an arrangement on an opposite side to the threading hook 20 with the needles 1-5 interposed therebetween, a thread holding member support mechanism 60 for movably supporting the thread holding member 50 between a threading position in an arrangement on the opposite side to the threading hook 20 with the needles 1-5 interposed therebetween and a standby position separated from the needles 1-5, a first support mechanism 100 for supporting the threading shaft 11 movably in the X-axis direction, a second support mechanism 200 for supporting the threading shaft 11 movably in the Y-axis direction, a positioning mechanism 400 for moving the threading shaft 11 to a corresponding position to a selected one of the needles 1-5 by an operation for a selecting dial 401 (a selecting portion), a selected needle indicating device 70 for distinguishably indicating one of the needles 1-5 with respect to which the threading shaft 11 is positioned through an operation of the selecting dial 401, and a main frame 90 for supporting each structure.

[Threading Shaft and Threading Hook]

Figure 5:
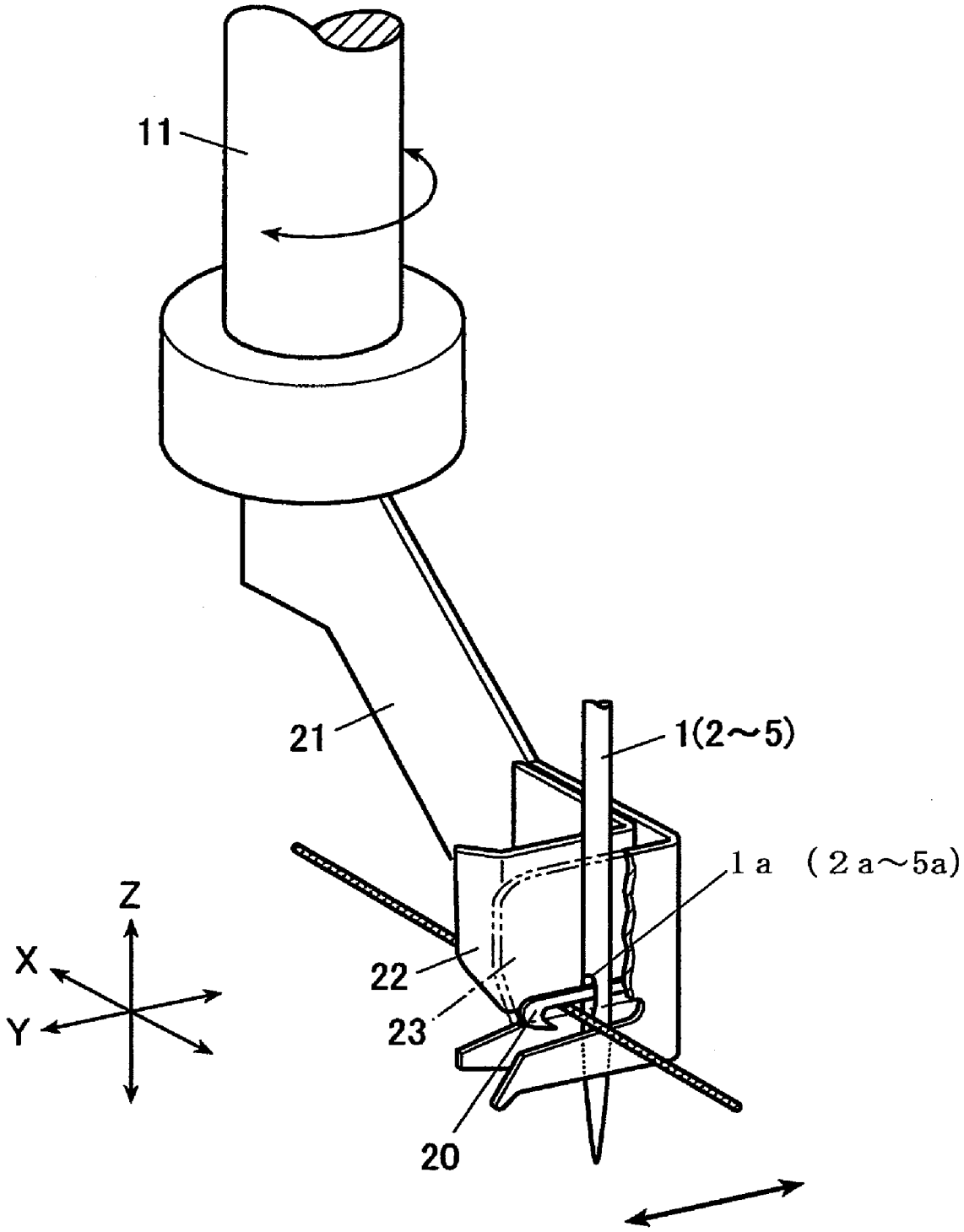
FIG. 5 is an enlarged perspective view showing a lower end portion of a threading shaft.

In FIG. 5, a hook holding arm 21 is fixed to a lower end of the threading shaft 11. The threading hook 20 supported in a tip part of the hook holding arm 21 has a hook portion formed in a tip part thereof. The hook portion in the tip part of the threading hook 20 can be inserted into any of eyes 1*a*-5*a* of the needles 1-5 in a forward movement through a rotation in one direction of the threading shaft 11, and furthermore, is removed from the eye while catching the thread by the hook portion in a return in a reverse direction to the threading shaft 11.

A pair of guide plates 22, 23 is provided in parallel in the tip part of the hook holding arm 21. The guide plates 22, 23 are provided apart from each other so as to enable an insertion of one of the needles 1-5 opposite to both sides of the threading hook 20. Furthermore, each of the guide plates 22, 23 has a thread guiding notch formed in a slightly lower position than the threading hook 20 in a direction of extension of the threading hook 20. By the guide plates 22, 23, it is possible to accurately guide any of the eyes of the needles 1-5 to the threading hook 20 in a forward movement.

[Main Frame]

The main frame 90 of the threading device 10 is fixed to a frame of an arm portion of the sewing machine which is not shown.

Figure 4:
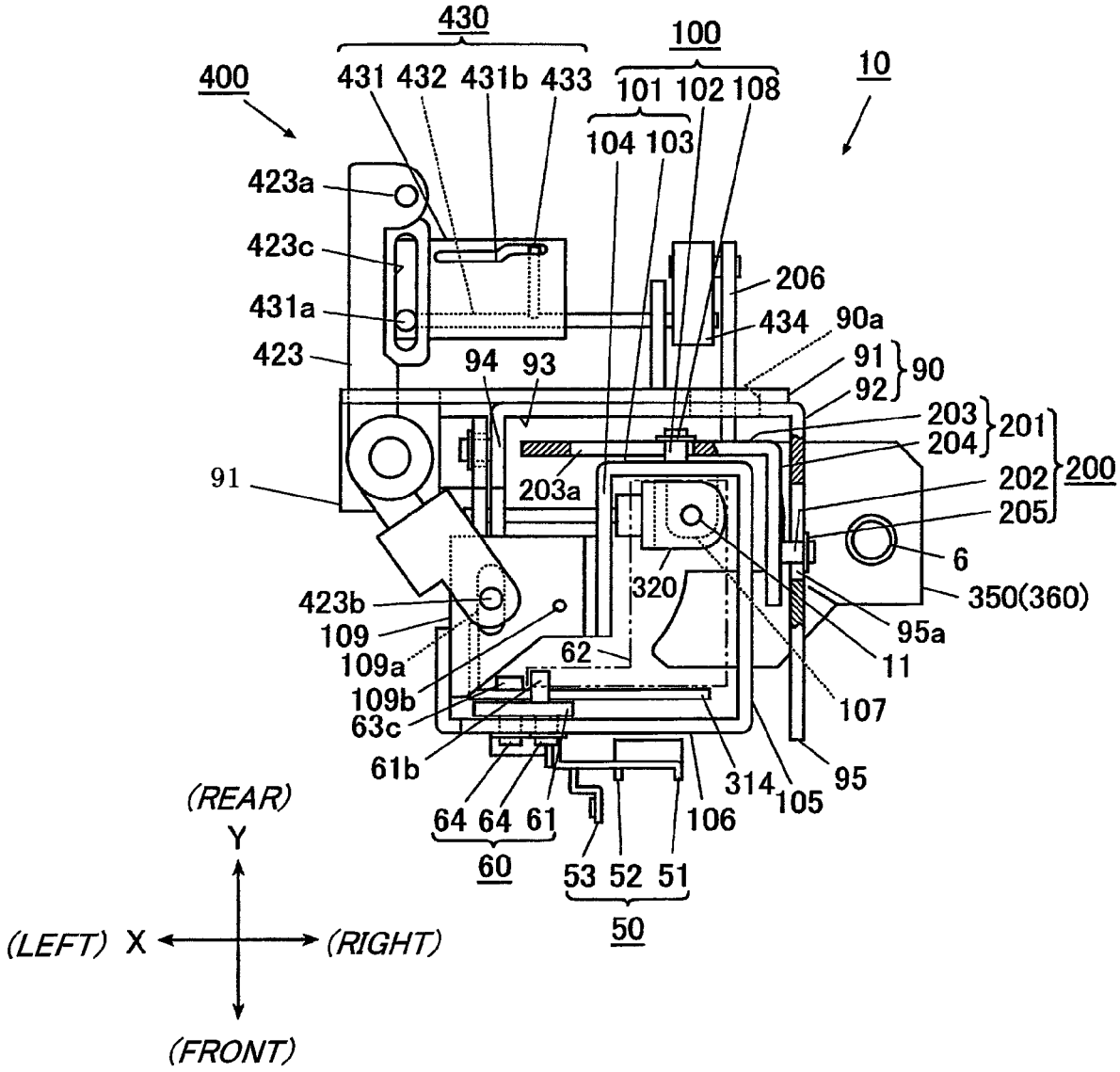
FIG. 4 is a plan view of a portion the threading device.

As shown in FIG. 4, the main frame 90 includes an almost planar back plate 91 fixed to and supported on the sewing machine frame and a front frame member 92 bent like a U shape and fixedly coupled to the back plate 91. The back plate 91 holds a main structure of the positioning mechanism 400.

The front frame member 92 has two left and right sidewall portions 94 and 95 which are mutually opposed to a rear sidewall portion 93 provided in cloth contact with the back plate 91. The left sidewall portion 94 on a left side in FIG. 4 (a sewing machine face portion side) has a smaller width (a length in the Y-axis direction) than that of the right sidewall portion 95.

Moreover, the rear sidewall portion 93 is set to have a smaller width (the X-axis direction) than that of the back plate 91, and the back plate 91 is greatly protruded leftward with respect to the rear sidewall portion 93.

The second support mechanism 200 is disposed on an inner region of the front frame member 92, and the first support mechanism 100 is disposed on a further inner side thereof.

[Second Support Mechanism]

As shown in FIG. 4, the second support mechanism 200 includes a second frame member 201 bent like an almost L shape and supported movably in the Y-axis direction with respect to the front frame member 92 of the main frame 90.

The second frame member 201 includes a rear sidewall portion 203 opposed to the rear sidewall portion 93 of the front frame member 92, and a right sidewall portion 204 opposed to the right sidewall portion 95 of the front frame member 92.

Figure 3:
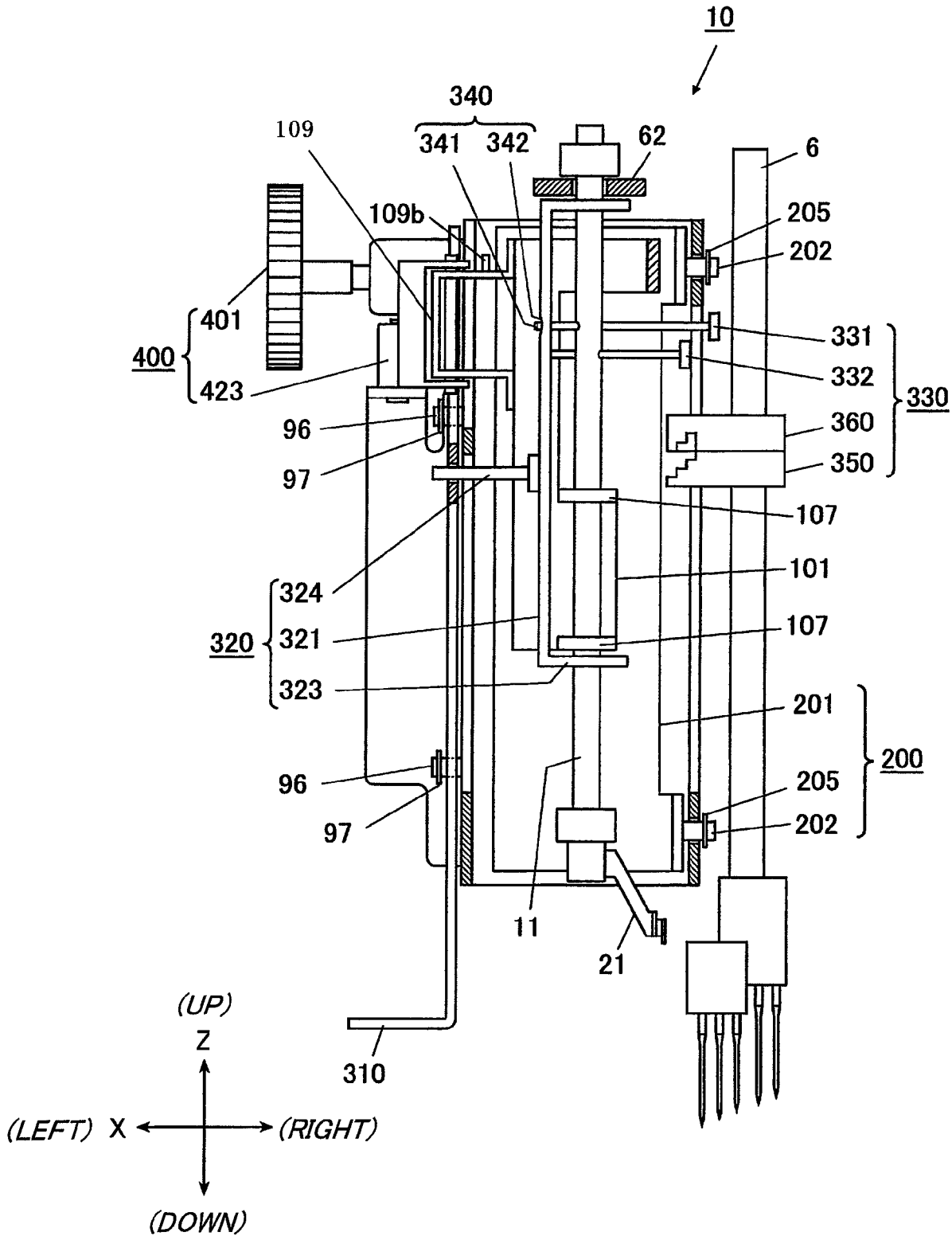
FIG. 3 is a front view a portion of the threading device.

As shown in FIGS. 3 and 4, cylindrical guide shafts 202 are protruded from upper and lower ends of the right sidewall portion 204, and a pair of long slots 95*a* is formed in the Y-axis direction on the right sidewall portion 95 of the front frame member 92 opposite to the guide shafts 202. Each of the guide shafts 202 is inserted through each of the slots 95*a* and has C rings 205 attached to a tip part thereof so that a slip from the slots 95*a* can be prevented.

When each of the guide shafts 202 is moved along the slot 95*a*, the second frame member 201, that is, the whole second support mechanism 200 can be moved in the Y-axis direction.

Furthermore, a bracket-shaped transmitting arm (an operation transmitting arm) 206 is protruded rearward from the rear sidewall portion 203 of the second frame member 201 and penetrates a horizontal through hole 90*a* provided on the main frame 90 and is thus coupled to the positioning mechanism 400 which will be described below.

[First Support Mechanism]

As shown in FIG. 4, the first support mechanism 100 includes a first frame member 101 supported movably in the X-axis direction with respect to the second frame member 201 of the second support mechanism 200.

The first frame member 101 includes a rear sidewall portion 103 opposed to the rear sidewall portion 203 of the second frame member 201, two left and right sidewall portions 104, 105 bent at a right angle from both ends of the rear sidewall portion 103 and opposed to each other, and a front sidewall portion 106 bent from one end of the right sidewall portion 105 and formed along an X-Z plane.

As shown in FIGS. 3 and 4, the rear sidewall portion 103 is vertically provided with two support brackets 107 for inserting and supporting the threading shaft 11 movably in a vertical direction.

Moreover, a cylindrical guide shaft 102 is protruded from upper and lower ends of the rear sidewall portion 103, and a pair of upper and lower slots 203*a* for inserting the respective guide shafts 102 is formed in the X-axis direction on the rear sidewall portion 203 of the second frame member opposite to the guide shafts 102. Each of the guide shafts 102 is inserted through each of the slots 203*a* and has a C ring 108 attached to a tip part thereof, thereby preventing a slip from the slot 203*a*.

The guide shaft 102 is slid along the slot 203*a* so that the first frame member 101 can be moved in the X-axis direction. More specifically, the first support mechanism 100 can be moved in the X-axis direction with respect to the second frame member 201 so that all the structures supported by the first frame member 101 can be moved in the X-axis and Y-axis directions with respect to the main frame 90 in cooperation of the first support mechanism 100 with the second support mechanism 200.

The left sidewall portion 104 is provided with a bracket 109 taking an almost U shape seen from a front and a tip part thereof is coupled to the positioning mechanism 400 which will be described below, and a moving force is transmitted from the bracket 109 to the first frame member 101 in the X-axis direction.

Moreover, a boss-shaped engaging projection 109*b* provided in an upper surface portion of the bracket 109 is engaged with a forked coupling arm 71*a* provided in an indicator moving member 71 of the selected needle indicating device 70 which will be described below, and has the function of transmitting a moving operation in the X-axis direction of the first frame member 101 to the indicator moving member 71.

Figure 2:
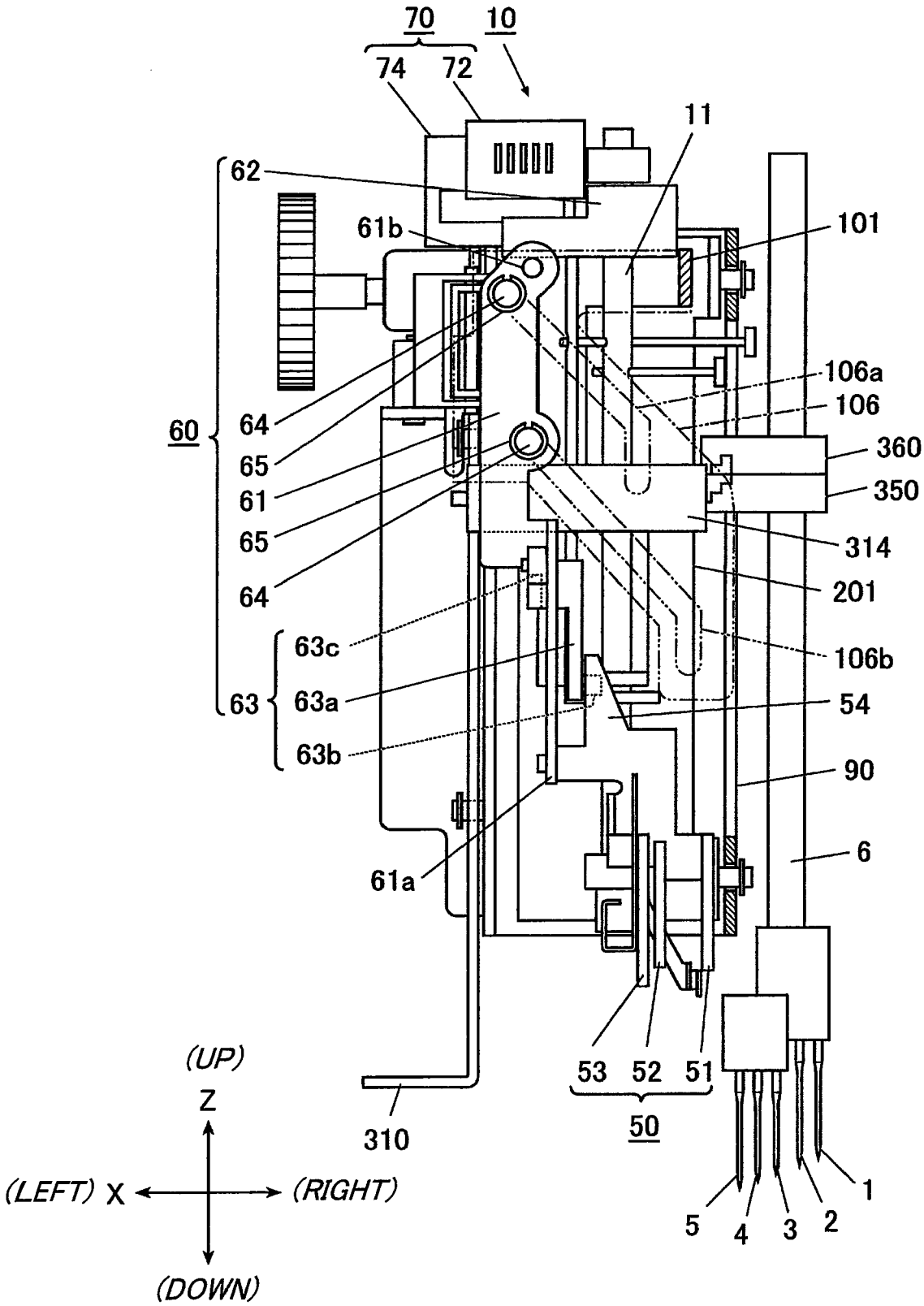
FIG. 2 is a front view of the threading device.

As shown in FIGS. 1 and 2, the front sidewall portion 106 is provided with guide grooves 106*a*, 106*b* for guiding a movement to a standby position and a threading position of a moving member 61 in the thread holding member support mechanism 60.

[Positioning Mechanism]

The positioning mechanism 400 will be described with reference to FIGS. 4, 6, 7, 8 and 9.

The positioning mechanism 400 has each structure supported mainly on the back plate 91 of the main frame 90.

The positioning mechanism 400 includes the selecting dial 401 for sequentially switching the position of the threading shaft 11 into the needles 1-5 so as to select one of the needles 1-5 through which a thread is to be inserted, a stage switching portion 410 for intermittently dividing a rotating operation of the selecting dial 401 corresponding to the positions of the respective needles 1-5, a first cam mechanism 420 for giving a moving operation in the X-axis direction to the threading shaft 11 through the operation of the selecting dial 401, and a second cam mechanism 430 for giving a moving operation in the Y-axis direction to the threading shaft 11 through the operation of the selecting dial 401.

[Selecting Dial and Stage Switching Portion]

Figure 6:
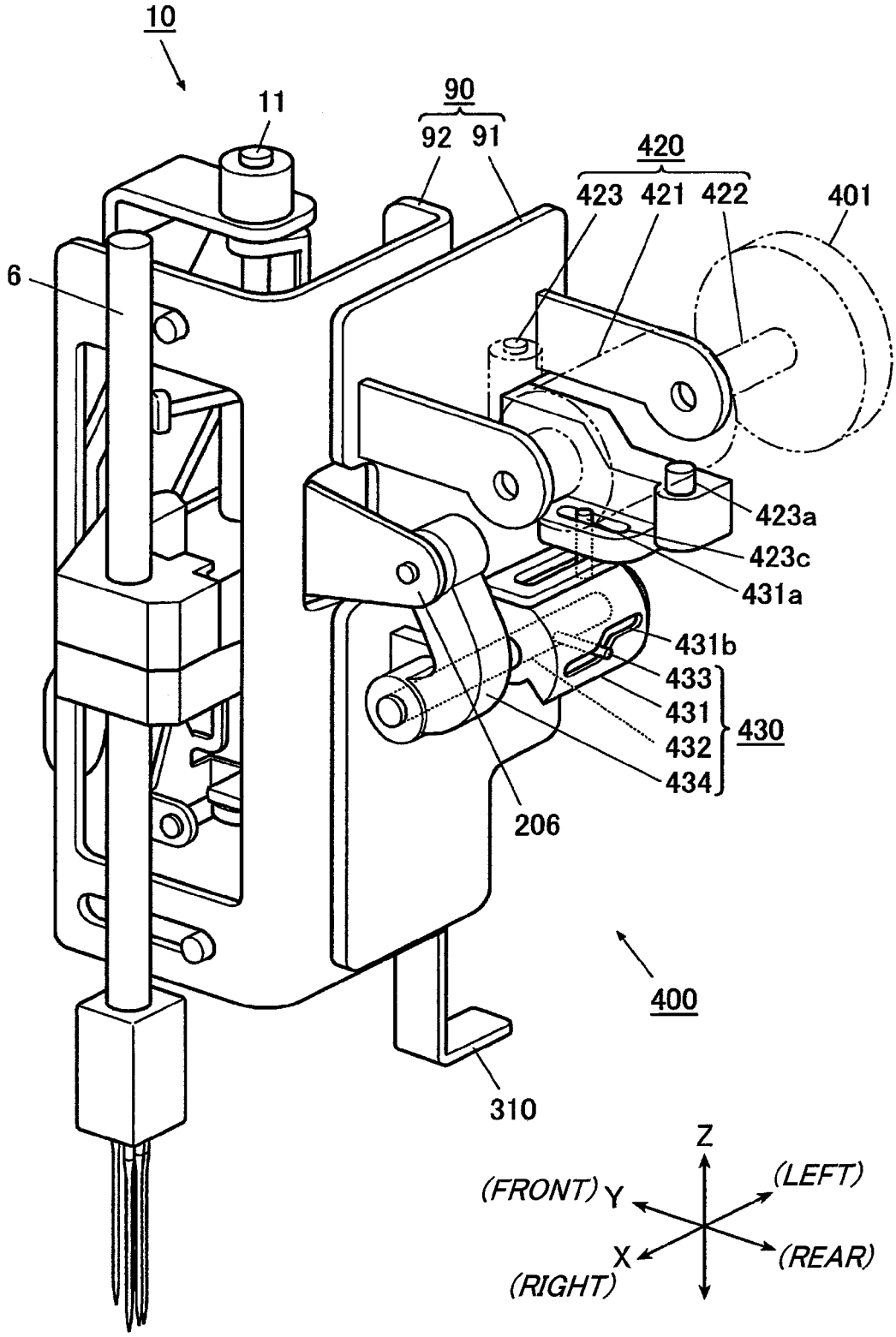
FIG. 6 is a perspective view of the threading device which is seen in a different direction from FIG. 1.
Figure 7:
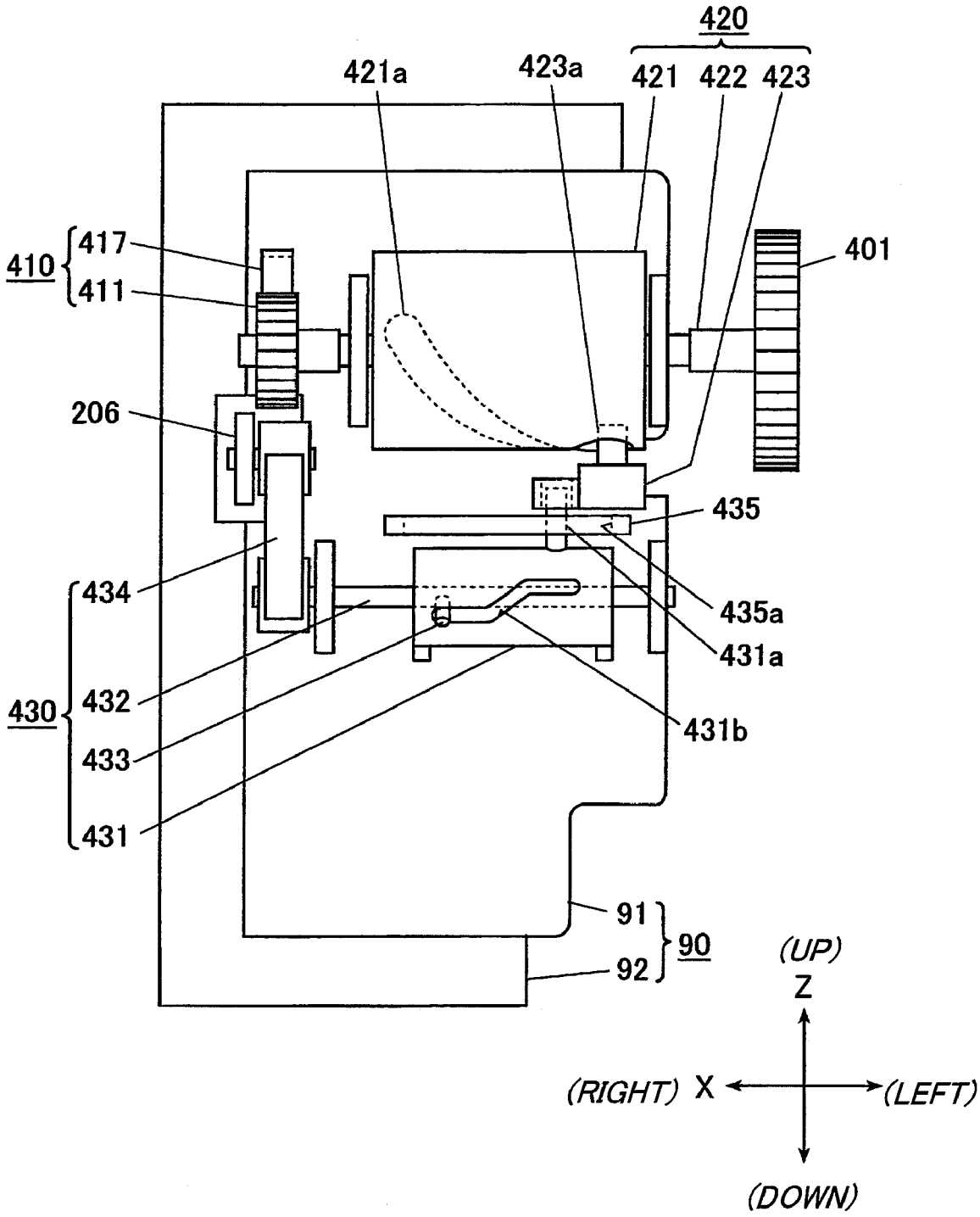
FIG. 7 is a rear view a portion of the threading device.

As shown in FIGS. 6 and 7, the selecting dial 401 is fixed to one end of a rotating support shaft 422 for pivotally supporting a first cam 421 of the first cam mechanism 420.

Figure 8:
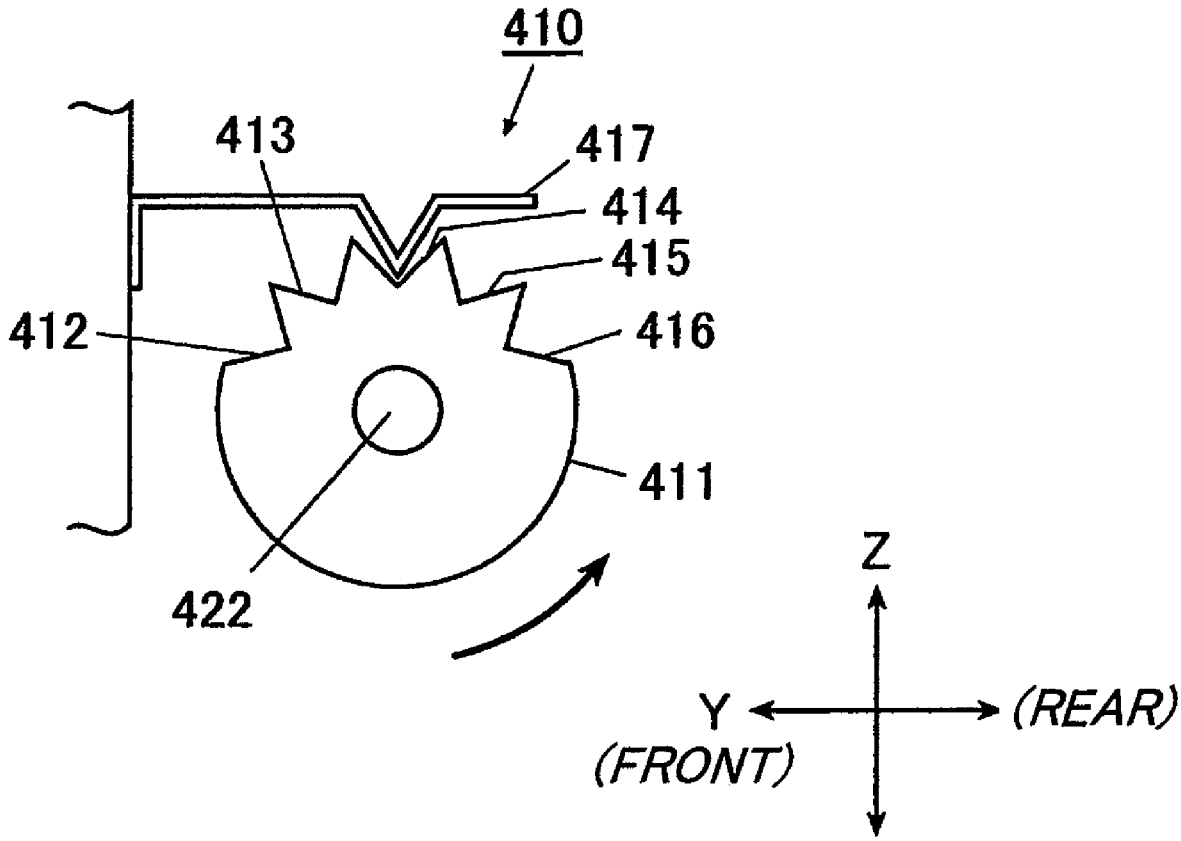
FIG. 8 is a side view of a stage switching portion of a selecting portion when seen from a right side.
Figure 9A:
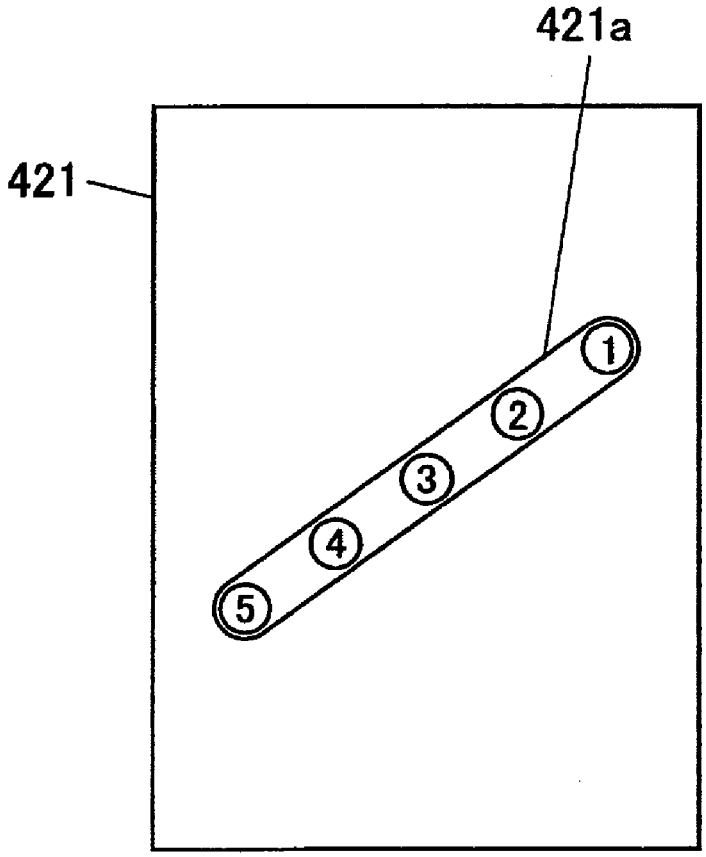
FIG. 9A is an explanatory view showing an expanded first cam and stage switching positions thereon.
Figure 9B:
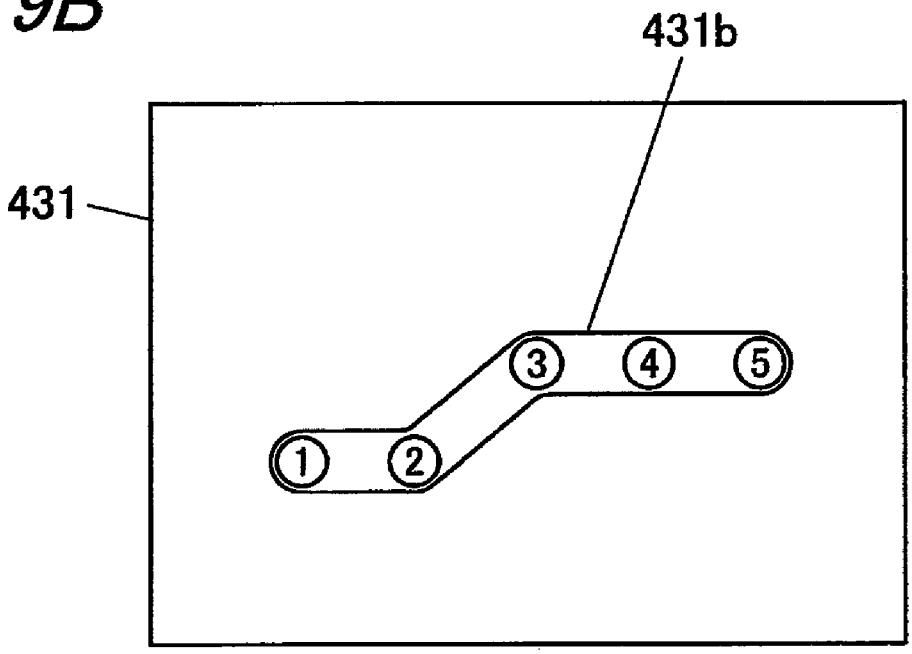
FIG. 9B is an explanatory view showing an expanded second cam and stage switching positions thereon.

As shown in FIG. 8, moreover, the stage switching portion 410 includes a rotor 411 of the stage switching portion 410 fixed to the other end of the rotating support shaft 422 and a leaf spring 417 having one end fixed to the back plate 91.

Engaging concave portions 412-416 corresponding to the needles 1-5 respectively are formed on a part of an outer periphery of the rotor 411, and the leaf spring 417 has a tip part provided with a projection capable of being fitted into the engaging concave portions 412-416, and always has an elastic force for causing the projection to come in pressure contact with the outer periphery of the rotor 411 and the projection is fitted into the engaging concave portions 412-416 to control the rotation of the rotor 411.

When the selecting dial 401 is rotated, therefore, the leaf spring 417 is moved back and forth to the engaging concave portions 412-416 by its own elastic force, thereby controlling the rotation into a fitting position, that is, one of the positions corresponding to the needles 1-5.

[First Cam Mechanism]

As shown in FIG. 7, the first cam mechanism 420 includes the rotating support shaft (first rotating support shaft) 422 supported rotatably with respect to the back plate 91 in the X-axis direction, the first cam 421 taking a cylindrical shape which is fixed to the rotating support shaft 422 and has an almost spiral cam groove 421*a* formed on an outer periphery (which is not shown in FIG. 4), and an oscillating arm 423 having an intermediate portion 423*d* supported rotatably around a vertical axis with respect to the back plate 91 and a projection 423*a* to be a cam follower which is engaged with the cam groove 421*a*.

As shown in FIG. 4, the bracket 109 of the first support mechanism 100 has a slot 109*a* formed in the Y-axis direction and an engaging pin 423*b* of the oscillating arm 423 is inserted into the slot 109*a*. The oscillating arm 423 is coupled to the bracket 109 provided on the first frame member 101 through the engaging pin 423*b* provided on the other end thereof.

When the first cam 421 is rotated in a clockwise direction as seen from a left, a moving force is applied in the X-axis direction (a rightward direction) to the follower projection 423*a* of the oscillating arm 423. Consequently, the other end of the oscillating arm 423 generates a leftward movement so that the first frame member 101 is moved in a leftward direction through the bracket 109. When the first cam 421 is rotated in a reverse direction, moreover, the first frame member 101 generates a movement in a rightward direction.

The slot 109*a* of the bracket 109 serves to permit a displacement in the Y-axis direction which is generated in a rotation of the other end of the oscillating arm 423, and furthermore, to permit a movement in the Y-axis direction of the first frame member 101 with a movement in the Y-axis direction of the second frame member 201 through the second cam mechanism 430 which will be described below.

[Second Cam Mechanism]

The second came mechanism 430 has a second cam 431 for oscillating the oscillating arm 423 and linearly moving the oscillating arm 423 in the X-axis direction, a rotating support shaft (a second rotating support shaft) 432 supported rotatably in the X-axis direction with respect to the back plate 91, a follower projection 433 provided on the rotating support shaft 432 and serving to convert the linear movement of the second cam 431 into a rotating operation and to transmit the rotating operation to the rotating support shaft 432, and an almost L-shaped link member 434 for applying a moving operation in the Y-axis direction through the operation transmitting arm 206 to the second frame member 201 by the rotation of the rotating support shaft 432.

The second cam 431 taking such a shape as to take a part of an outer peripheral surface taking a shape of a hollow cylinder away is supported slidably in the X-axis direction through the rotating support shaft 432.

Moreover, the outer peripheral surface of the second cam 431 is provided with an engaging projection 43 la which is protruded outward, and the engaging projection 431*a* is inserted into a slot 423*c* formed in a longitudinal direction at one end side of the oscillating arm 423. When the oscillating arm 423 is oscillated by the rotation of the first cam 421, the second cam 431 is moved in the X-axis direction. A detent 435 shown in FIG. 7 controls the movement in the Y-axis direction of the engaging projection 431*a* and the rotation of the second cam 431 through the insertion of the engaging projection 431*a* of the second cam 431 into a slot 435*a* formed in the X-axis direction.

Furthermore, the outer peripheral surface of the second cam 431 is provided with a guide hole 431*b* into which a tip part of the follower projection 433 is inserted. The guide hole 431*b* has an almost spiral section (an inclined portion in FIG. 7) formed in an intermediate part thereof. When the follower projection 433 is engaged with the almost spiral section, it is moved in a circumferential direction to rotate the rotating support shaft 432.

A link member 434 having a lower end supported pivotally on the rotating support shaft 432 has an upper end coupled to the transmitting arm 206 extended from the second frame member 201. When the link member 434 is rotated interlockingly with the rotation of the rotating support shaft 432, the transmitting arm 206 is moved in the Y-axis direction so that the second frame member 201 and the first frame member 101 which are coupled to the transmitting arm 206 are moved in the Y-axis direction.

[Operation of Positioning Mechanism]

Next, a switching operation in five stages of the selecting dial 401 will be described with reference to FIG. 9.

(1) A state in which the selecting dial 401 is adjusted into a position in which the engaging projection of the leaf spring 417 is fitted in the engaging concave portion 412 is set to be a first state. At this time, the projection 423*a* is placed in a first position of FIG. 9A at one end side of the cam groove 421*a* and the first frame member 101 is positioned on a rightmost side. Moreover, the follower projection 433 is placed in a first position of FIG. 9B at one end side of the guide hole 431*b* and the second frame member 201 is positioned on a rearmost side. By the arrangement of the first and second frame members 101 and 201, the threading shaft 11 is placed in a position in which the threading hook 20 inserts a thread through the needle 1.

(2) A state in which the selecting dial 401 is adjusted into a position in which the engaging projection of the leaf spring 417 is fitted in the engaging concave portion 413 is set to be a second state. At this time, the projection 423*a* is placed in a second position of FIG. 9A in the cam groove 421*a* and the first frame member 101 generates a leftward movement. Moreover, the follower projection 433 is placed in a second position of FIG. 9B in the guide hole 431*b* and the second frame member 201 does not generate the movement in the state of (1). In this case, a moving distance of the first frame member 101 is coincident with an interval in the X-axis direction between the needles 1 and 2. By the arrangement of the first and second frame members 101 and 201, the threading shaft 11 is placed in a position in which the threading hook 20 inserts a thread through the needle 2.

(3) A state in which the selecting dial 401 is adjusted into a position in which the engaging projection of the leaf spring 417 is fitted in the engaging concave portion 414 is set to be a third state. At this time, the projection 423*a* is placed in a third position of FIG. 9A in the cam groove 421*a* and the first frame member 101 generates the leftward movement. Moreover, the follower projection 433 is placed in a third position of FIG. 9B in the guide hole 431*b* and the second frame member 201 generates a movement toward a front side. In this case, a moving distance of the first frame member 101 is coincident with an interval in the X-axis direction between the needles 2 and 3 and a moving distance of the second frame member 201 is coincident with an interval in the Y-axis direction between the needles 2 and 3. By the arrangement of the first and second frame members 101 and 201, accordingly, the threading shaft 11 is placed in a position in which the threading hook 20 inserts a thread through the needle 3.

(4) A state in which the selecting dial 401 is adjusted into a position in which the engaging projection of the leaf spring 417 is fitted in the engaging concave portion 415 is set to be a fourth state. At this time, the projection 423*a* is placed in a fourth position of FIG. 9A in the cam groove 421*a* and the first frame member 101 generates the leftward movement. Moreover, the follower projection 433 is placed in a fourth position of FIG. 9B in the guide hole 431*b* and the second frame member 201 does not generate the movement in the state of (3). In this case, a moving distance of the first frame member 101 is coincident with an interval in the X-axis direction between the needles 3 and 4. By the arrangement of the first and second frame members 101 and 201, the threading shaft 11 is placed in a position in which the threading hook 20 inserts a thread through the needle 4.

(5) A state in which the selecting dial 401 is adjusted into a position in which the engaging projection of the leaf spring 417 is fitted in the engaging concave portion 416 is set to be a fifth state. At this time, the projection 423*a* is placed in a fifth position of FIG. 9A in the cam groove 421*a* and the first frame member 101 generates the leftward movement. Moreover, the follower projection 433 is placed in a fifth position of FIG. 9B in the guide hole 431*b* and the second frame member 201 does not generate the movement in the state of (3). In this case, a moving distance of the first frame member 101 is coincident with an interval in the X-axis direction between the needles 4 and 5. By the arrangement of the first and second frame members 101 and 201, the threading shaft 11 is placed in a position in which the threading hook 20 inserts a thread through the needle 5.

By carrying out the position switching operation over the selecting dial 401 from the first state to the fifth state in order as shown in the (1) to (5), it is possible to position the threading shaft 11 in the position in which the threading hook 20 can insert the thread into the positions of the needles 1-5, thereby carrying out the threading work over them.

[Threading Mechanism]

The threading mechanism 300 will be described with reference to FIGS. 2, 3 and 10 to 14.

The threading mechanism 300 includes an operation lever 310 to be operating means for moving the threading shaft 11 downward and giving a threading operation, a threading slide guide 320 to be an up-down frame member for carrying out a downward moving operation together with the threading shaft 11 through a downward operation of the operation lever 310, a height regulating mechanism 330 for blocking the downward movement of the threading shaft 11 in a plurality of heights corresponding to the heights of the eyes of the needles 1-5, and a threading cam mechanism 340 for rotating the threading shaft 11 in such a direction that the threading hook 20 is moved forward when only the threading slide guide 320 is moved downward with respect to the threading shaft 11.

[Threading Slide Guide]

The threading slide guide 320 includes a back plate 321 which is vertically long and has an arcuate section, plate-shaped support portions 322 and 323 provided integrally with both of upper and lower ends thereof and provided with through holes for inserting the threading shaft 11 therethrough, and an engaging shaft 324 with the operation lever 310 extended leftward in the X-axis direction from the back plate 321.

The support portions 322 and 323 are plate-shaped along an X-Y plane and are provided with through holes for inserting the threading shaft 11 therethrough, and the threading slide guide 320 is coupled to the threading shaft 11 slidably along the threading shaft 11 via the through holes. A compression coil spring 325 is inserted between the upper support portion 322 and a first guide pin 331 provided on the threading shaft which will be described below, and a stopper 11*a* to abut on an upper surface of the support portion 322 is provided on an upper end of the threading shaft 11. Therefore, the threading shaft 11 and the threading slide guide 320 are always energized in a state in which the threading shaft 11 is pressed downward and the threading slide guide 320 is pressed upward.

[Operation Lever]

Figure 10:
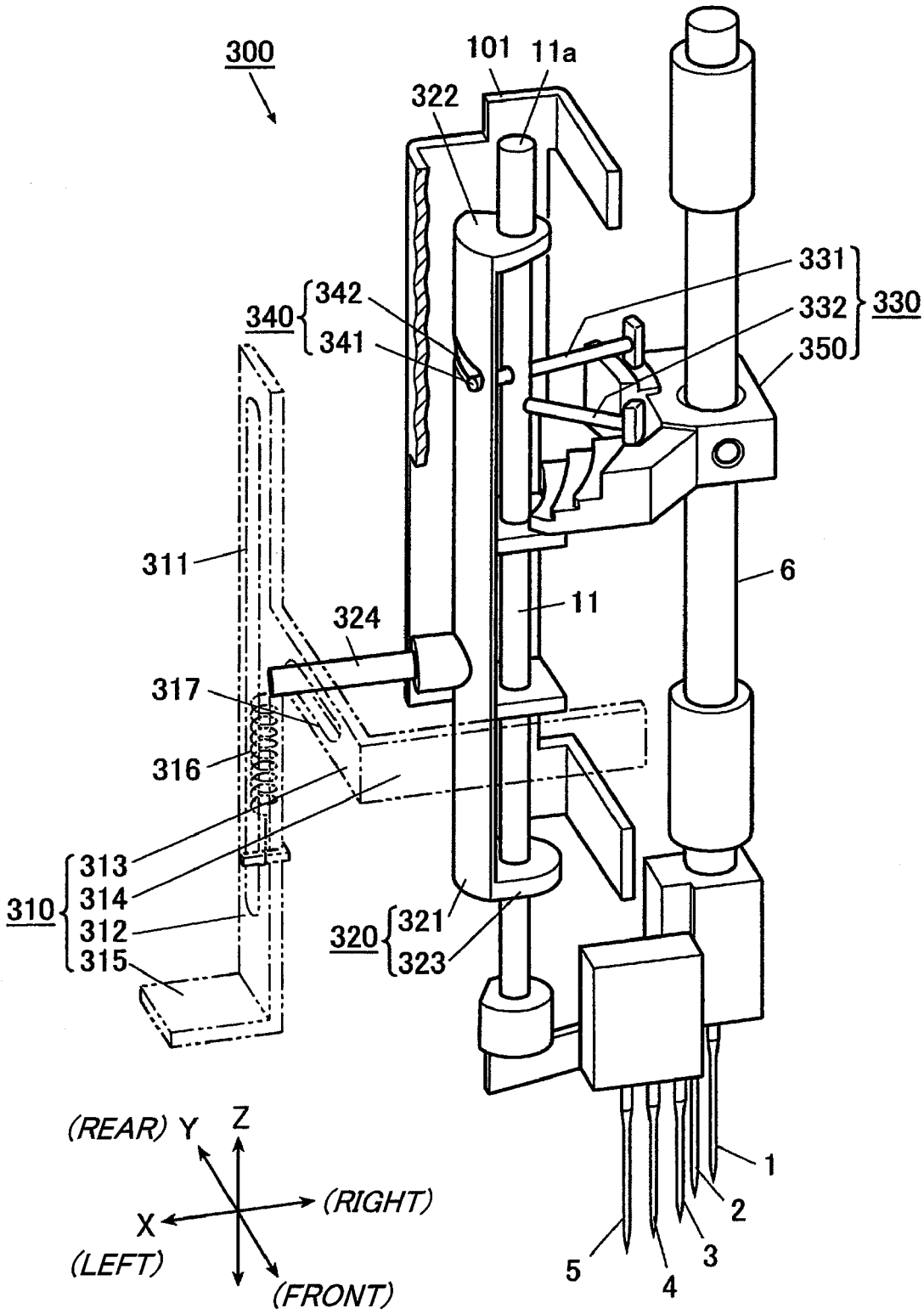
FIG. 10 is a perspective view of a threading mechanism.
Figure 11:
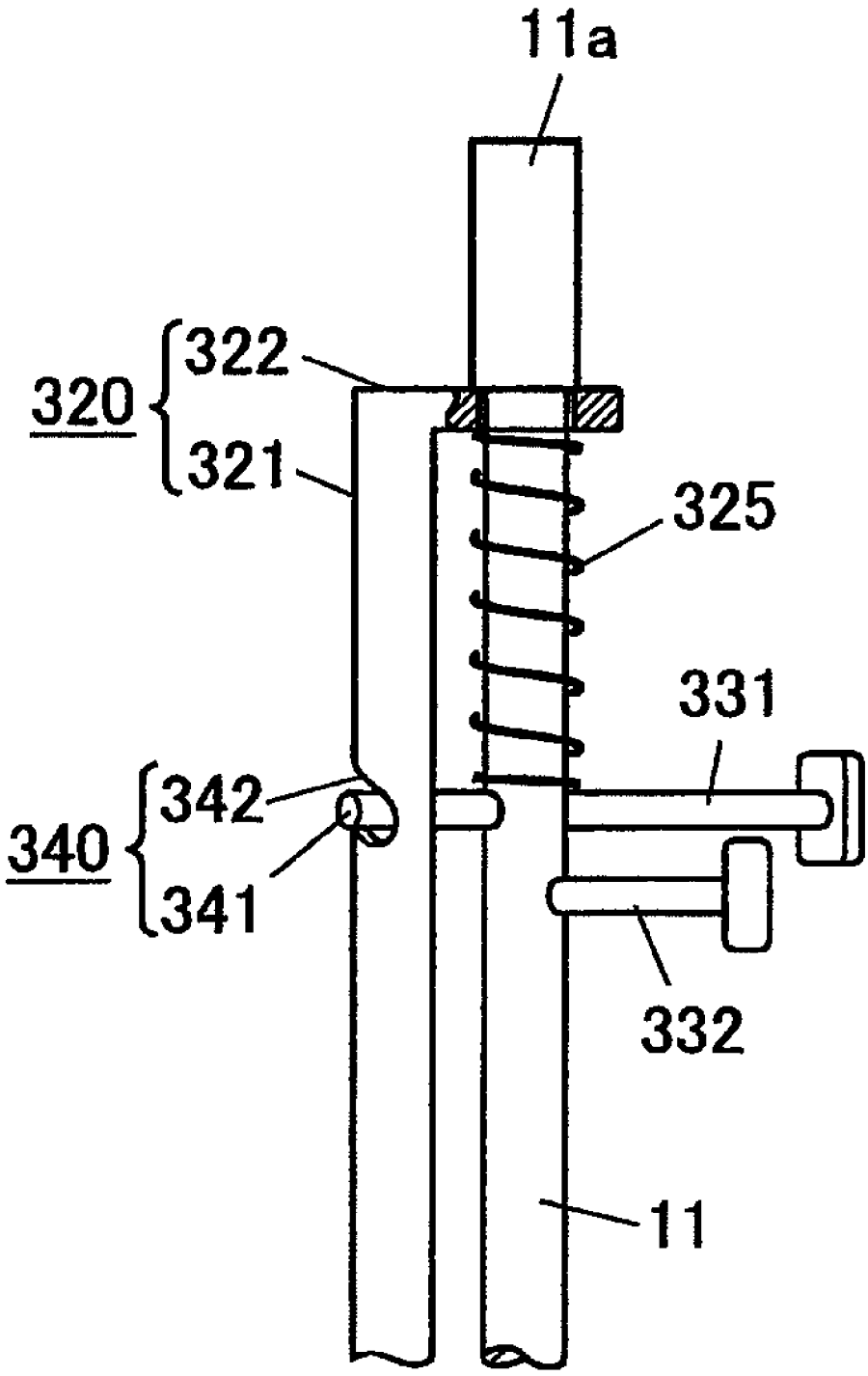
FIG. 11 is an explanatory view of a portion of a threading cam mechanism.
Figure 12:
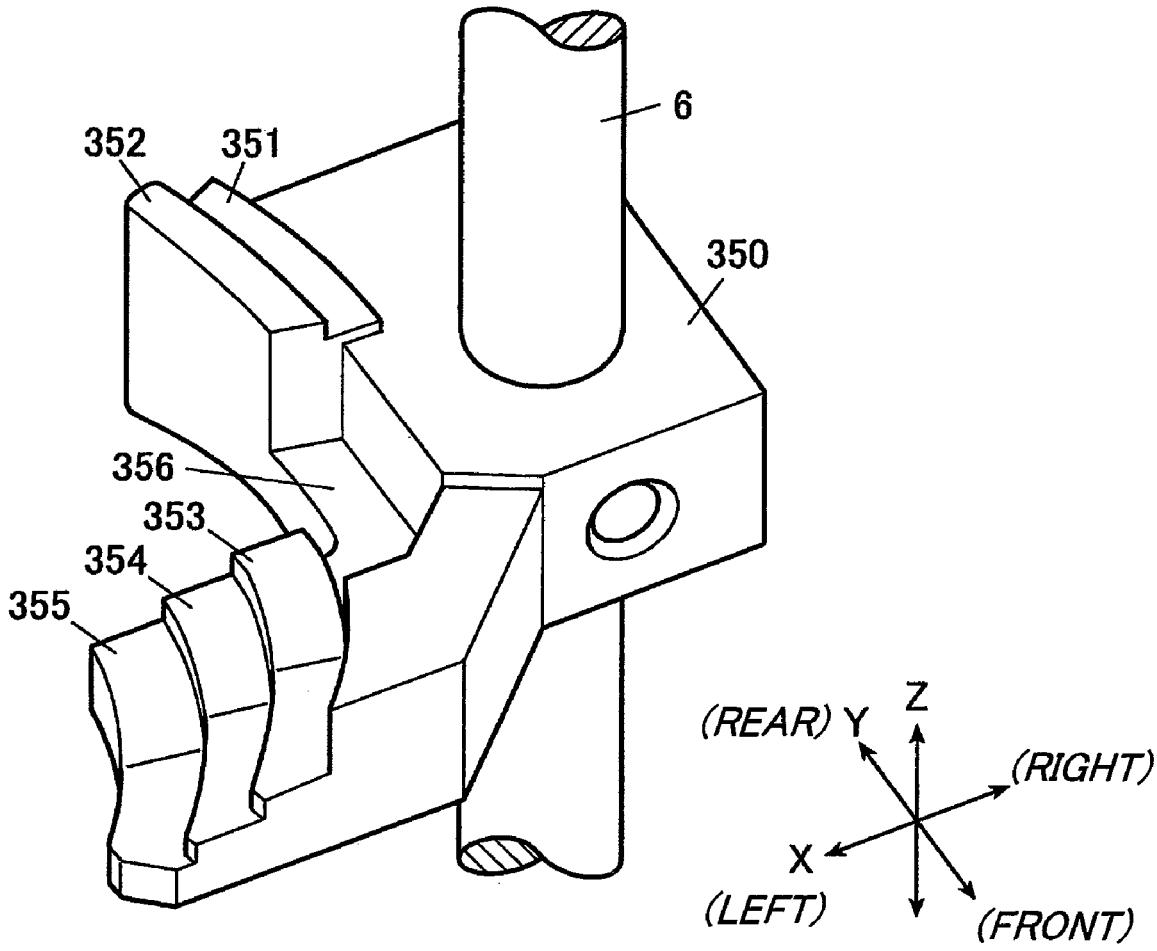
FIG. 12 is a perspective view of a lower threading guide.

As shown in FIGS. 3 and 10, the operation lever 310 is provided on a left side surface of the left sidewall portion 94 of the main frame 90 and has a vertical slot 311 for inserting two guide shafts 96 protruded leftward in upper and lower positions on a left side surface of the left sidewall portion 94, and is held by a C ring 97 provided in a tip part of each of the guide shafts 96 so as not to slip off. The operation lever 310 is supported to be vertically movable with respect to the main frame 90 by the structure.

The operation lever 310 includes a long body portion 312 in a vertical direction, an arm portion 313 extended in an orthogonal direction (the Y-axis direction) to the body portion 312 in the vicinity of the middle of the body portion 312, and a thread holding member operating portion 314 bent at a right angle in a tip part of the arm portion 313 and extended in the X-axis direction.

The slot 311 is formed to penetrate the body portion 312. Moreover, a lower end of the body portion 312 is bent at a right angle so that a protruded portion 315 extended in the X-axis direction is formed and a downward pressing operation is carried out therein. Furthermore, the body portion 312 is coupled to the main frame 90 through a tension spring 316 and an upward tensile force is always energized.

On the other hand, a slot 317 is formed to penetrate the arm portion 313 in the Y-axis direction and the engaging shaft 324 extended from the threading slide guide 320 is inserted therein. Accordingly a downward moving operation applied to the operation lever 310 is transmitted from the arm portion 313 to the threading slide guide 320 and the threading shaft 11 through the engaging shaft 324. The slot 317 of the arm portion 313 is provided in the Y-axis direction in order to permit a movement in the Y-axis direction through the second support mechanism 200.

The thread holding member operating portion 314 serves to give an operation for moving the thread holding member 50 close to the needle side in the forward movement of the threading hook 20. The thread holding member operating portion 314 is provided in the operation lever 310 to implement an interlocking motion of the forward moving operation of the threading hook 20 and the close motion of the thread holding member 50. An action of the thread holding member operating portion 314 on the thread holding member 50 will be described in detail in an explanation of the thread holding member support mechanism 60.

[Threading Cam Mechanism]

The threading cam mechanism 340 includes an engaging projection 341 protruded in a horizontal direction from the threading shaft 11 toward the back plate 321 of the threading slide guide 320 and a slot portion 342 to be a groove cam formed on the back plate 321 of the threading slide guide 320.

The engaging projection 341 actually serves as a rear end of the first guide pin 331 provided to penetrate the threading shaft 11 which will be described below. The engaging projection 341 is set to have such a length as to be inserted into the slot portion 342 formed to penetrate the back plate 321 and to penetrate the back plate 321 to an outside. The slot portion 342 is formed with a longitudinal direction inclined to a vertical direction. The engaging projection 341 is maintained to be usually positioned on a lower end of the slot portion 342 by an action of the compression coil spring 325 provided between the threading shaft 11 and the threading slide guide 320. The slot portion 342 is inclined in such a direction as to generate a displacement in a direction in which the threading shaft 11 is rotated toward the forward movement of the threading hook 20 when the engaging projection 341 is moved upward along the slot portion 342. More specifically, the threading shaft 11 is rotated clockwise as seen on a plane so that the threading hook 20 is moved forward. Therefore, the slot portion 342 is inclined upward in such a direction as to be turned toward the rear side in the Y-axis direction.

In the case in which the threading slide guide 320 is relatively moved downward with respect to the threading shaft 11, the engaging projection 341 is moved upward along the slot portion 342. As described above, the threading shaft 11 and the threading slide guide 320 are moved vertically until a greater force than a pressing force of the compression coil spring 325 is applied by the action of the compression coil spring 325 provided between the threading shaft 11 and the threading slide guide 320 and the stopper 11*a* provided on the upper end of the threading shaft 11. Accordingly, the height regulating mechanism 330 for blocking a downward movement is provided in the middle of a downward moving path of the threading shaft 11. When the downward moving operation is applied to the threading slide guide 320 and the threading shaft 11 through the operation lever 310, the downward movement of only the threading shaft 11 is blocked in the middle. In this case, when a greater pressing force than the compression coil spring 325 is applied from the operation lever 310, the threading slide guide 320 is relatively moved downward with respect to the threading shaft 11 so that the threading shaft 11 is rotated by the action of the threading cam mechanism 340 and the threading hook 20 is moved forward to carry out the threading operation. The threading hook 20 is moved backward by a return force of the compression coil spring 325 through the release of the operation lever 310.

[Height Regulating Mechanism]

The height regulating mechanism 330 has the function of blocking the downward movement of only the threading shaft 11 in order to operate the threading cam mechanism 340 and the function of regulating the height of the threading hook 20 for each of the needles 1-5 in cooperation with the positioning mechanism 400 for moving and positioning the threading shaft 11 corresponding to the arrangement of the needles 1-5 in the threading operation of the needles 1-5.

More specifically, the height regulating mechanism 330 includes first and second guide pins 331, 332 provided on the threading shaft 11, a lower threading guide 350 having five abutting portions 351-355 on which either one of the guide pins 331, 332 abuts from above, and an upper threading guide 360 (which is not shown in FIG. 10) for guiding a revolution of each of the guide pins 331, 332 in the rotation of the threading shaft 11.

Both of the first and second guide pins 331, 332 are provided perpendicularly to the threading shaft 11, and the first guide pin 331 is disposed in an upper position. Moreover, the two guide pins 331, 332 are disposed on the threading shaft 11 at different angles around the threading shaft 11 over the X-Y plane.

Figure 13A:
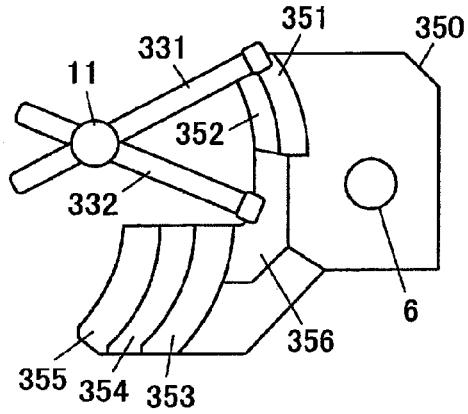
FIGS. 13A to 13E are explanatory views showing a relationship between guide pins and abutting portions in cases in which a threading shaft is positioned so as to correspond to each of the needles through a positioning mechanism.
Figure 13D:
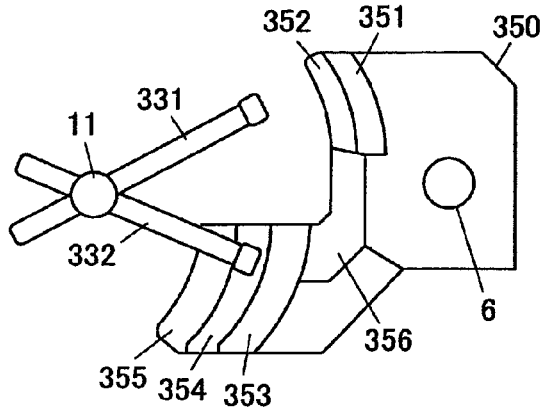
Figure 13B:
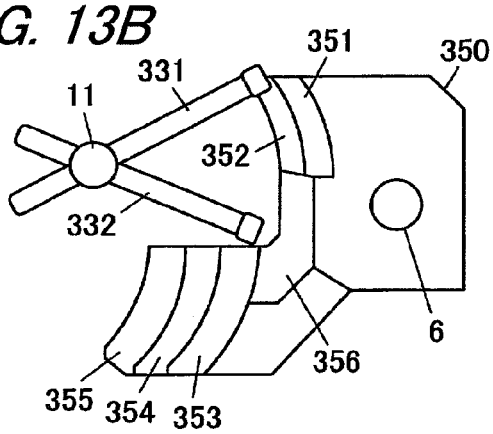
Figure 13E:
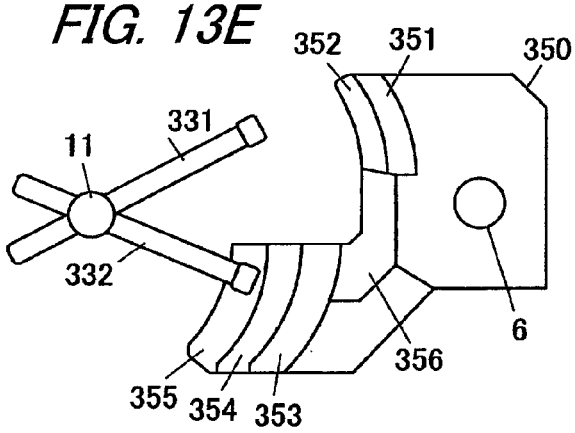
Figure 13C:
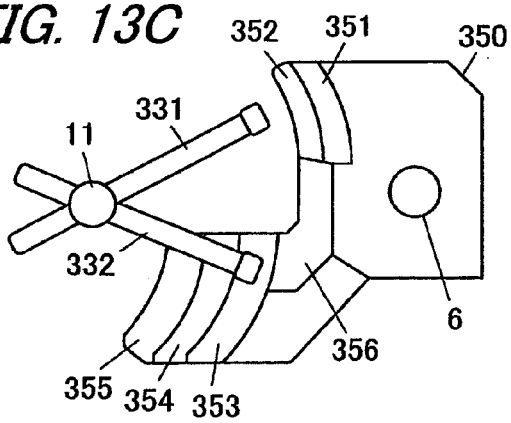
Figure 13C:
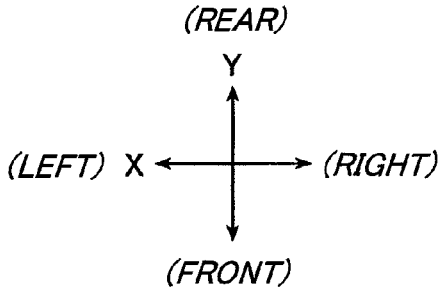

As shown in FIG. 13A, the abutting portion 351 is disposed in a position in which the first guide pin 331 is moved downward to abut thereon when the threading shaft 11 is placed in a position in which the thread is to be inserted through the needle 1. As shown in FIG. 13B, the abutting portion 352 is disposed in a position in which the first guide pin 331 is moved downward to abut thereon when the threading shaft 11 is placed in a position in which the thread is to be inserted through the needle 2. As shown in FIG. 13C, the abutting portion 353 is disposed in a position in which the second guide pin 332 is moved downward to abut thereon when the threading shaft 11 is placed in a position in which the thread is to be inserted through the needle 3. As shown in FIG. 13D, the abutting portion 354 is disposed in a position in which the second guide pin 332 is moved downward to abut thereon when the threading shaft 11 is placed in a position in which the thread is to be inserted through the needle 4. As shown in FIG. 13E, the abutting portion 355 is disposed in a position in which the second guide pin 332 is moved downward to abut thereon when the threading shaft 11 is placed in a position in which the thread is to be inserted through the needle 5.

Moreover, all of the planes of the abutting portions 351-355 are formed to have substantially arcuate shapes in such a manner that the guide pins 331, 332 can maintain the abutting state when the threading shaft 11 abuts to carry out the rotation.

Furthermore, the abutting portions 351-355 serve to determine the heights of the threading shaft 11 and the threading hook 20 in the threading operation respectively. Therefore, respective planar heights are set to be varied depending on the heights of the eyes of the needles 1-5.

In addition, the abutting portions 351 and 352 and the abutting portions 353, 354 and 355 are disposed apart from each other depending on opening angles of the guide pins 331, 332 around the threading shaft 11 respectively. Thus, a plurality of abutting portions is distributed and disposed corresponding to the number of the guide pins to avoid an interference with the arrangement of each of the abutting portions.

Moreover, two guide pins 331, 332 are present. A difference in a height is made between the first guide pin 331 and the second guide pin 332 in such a manner that one of the guide pins 331, 332 does not abut on any of the abutting portions when the other abuts on the abutting portion. Furthermore, a relief portion 356 is formed to be partially lower than an upper surface in such a manner that one of the guide pins does not abut on a portion other than the abutting portion of the lower threading guide 350 when the other guide pin abuts on the abutting portion (see FIG. 13A).

The lower threading guide 350 has the function of determining the height of the threading hook 20 in the threading operation. For this reason, a height of a certain section is always required. Accordingly, a sewing machine motor is controlled in such a manner that the needle bar is set to have an upper shaft angle in a predetermined certain section to always obtain the same threading enable section in the threading operation.

Figure 14:
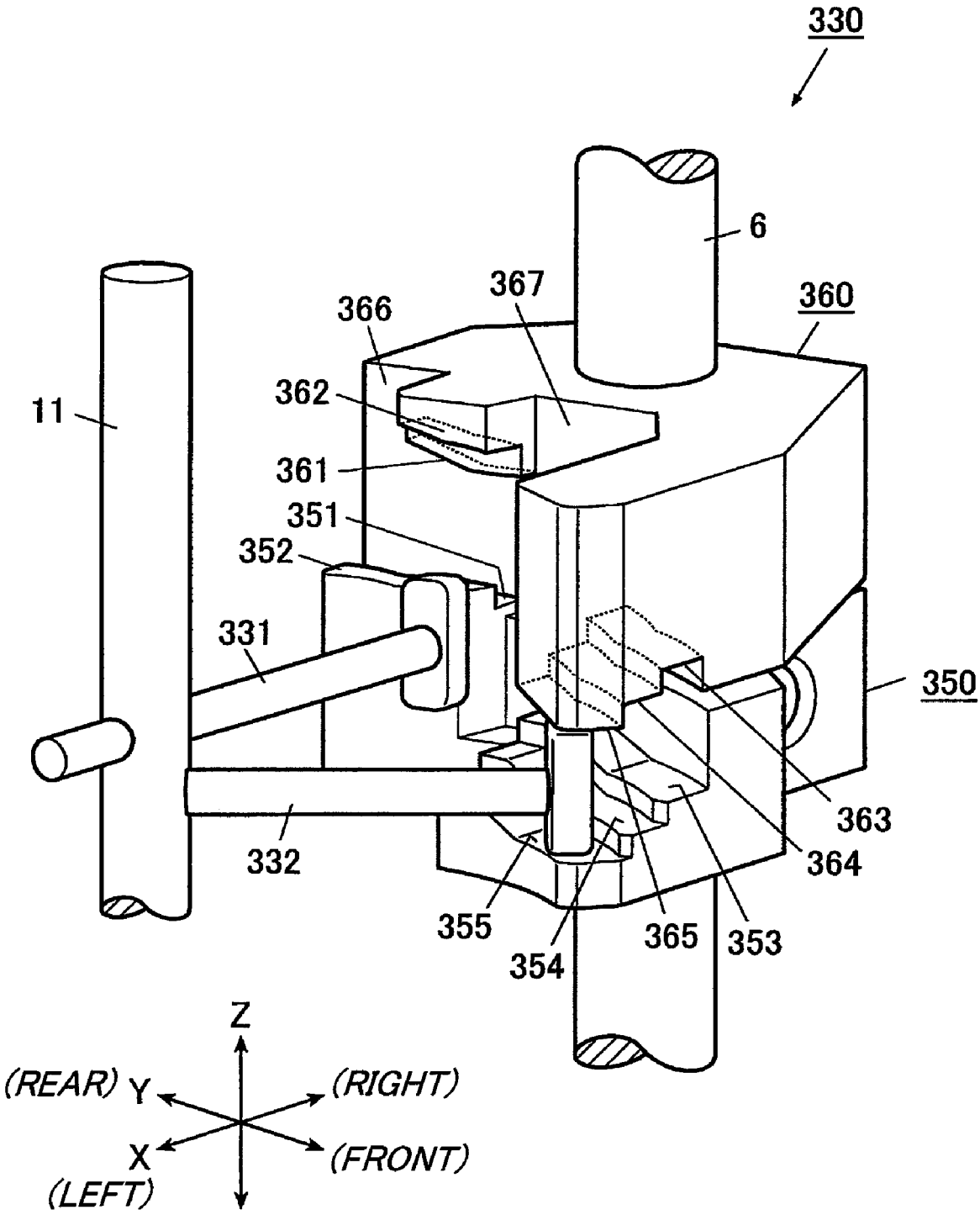
FIG. 14 is an enlarged perspective view of the lower threading guide and an upper threading guide.

In FIG. 14, the upper threading guide 360 has the function of guiding the guide pin in abutment from above so as to maintain an abutment when any of the guide pins 331, 332 abutting on the abutting portions 351-355 of the lower threading guide 350 is moved over the upper surfaces of the abutting portions 351-355 through the rotation of the threading shaft 11.

As shown in FIG. 14, accordingly, the upper threading guide 360 includes a guide portion 361 for guiding in abutment when the first guide pin 331 is moved in abutment on the abutting portion 351 of the lower threading guide 350, a guide portion 362 for guiding in abutment when the first guide pin 331 is moved in abutment on the abutting portion 352, a guide portion 363 for guiding in abutment when the second guide pin 332 is moved in abutment on the abutting portion 353, a guide portion 364 for guiding in abutment when the second guide pin 332 is moved in abutment on the abutting portion 354, a guide portion 365 for guiding in abutment when the second guide pin 332 is moved in abutment on the abutting portion 355, a relief portion 366 for permitting a downward movement of the first guide pin 331 in the downward movement of the threading shaft 11, and a relief portion 367 for permitting a downward movement of the second guide pin 332 in the downward movement of the threading shaft 11.

[Thread Holding Portion]

The thread holding portion 50 is a member formed by bending a plate, and includes two thread guarding portions 51, 52 for guarding a thread at a lower end and an interposing portion 53 having a leaf spring for interposing the thread end as shown in FIG. 2. The two thread guarding portions 51, 52 have notches for guarding a thread respectively (not shown) and the thread is provided over them and can be thus laid in the X-axis direction. Moreover, the interposing portion 53 comes in pressure contact with a holding plate and the leaf spring and can interpose the thread end through an insertion therein. Moreover, the interposing portion 53 is adjacent in a direction in which the two thread guarding portions 51, 52 are provided side by side. The interposing portion 53 is caused to interpose a residual end of the thread in the case in which the thread guarding operation is carried out with the thread laid over the two thread guarding portions 51, 52. Consequently, the thread can be maintained to be stretched in the X-axis direction between the two thread guarding portions 51, 52.

By interposing the thread and disposing the thread holding member 50 at an opposite side to the threading hook 20 in a state in which the thread is stretched in the X-axis direction, thus, it is possible to smoothly catch the thread through a return part in a rearward movement when the threading hook 20 moved forward in the Y-axis direction passes just above the thread which is orthogonal thereto.

[Thread Holding Member Support Mechanism]

As shown in FIGS. 2 and 4, the thread holding member support mechanism 60 includes the moving member 61 to be moved by the guide grooves 106*a*, 106*b* of the front sidewall portion 106 while holding the thread holding portion 50 oscillatably, an interlocking member 62 for moving the moving member 61 downward with the downward movement of the threading shaft 11, and an oscillating lever 63 for oscillating the thread holding portion 50 placed in a threading position toward the needle side.

The moving member 61 is a long plate and is disposed in a vertical direction, and guide shafts 64 are provided in two places in an upper part thereof. The guide shafts 64 are inserted into the guide grooves 106*a*, 106*b* of the front sidewall portion 106 respectively and are fixed with a C ring 65 from a front side. With the structure, the moving member 61 can carry out a movement along the guide grooves 106*a*, 106*b*. A position of the thread holding portion 50 in the case in which the moving member 61 is placed on upper ends of the guide grooves 106*a*, 106*b* is set to be a standby position, and a position of the thread holding portion 50 in the case in which the moving member 61 is positioned on lower ends of the guide grooves 106*a*, 106*b* is set to be a threading position.

A boss-shaped projection 61*b* is provided on a rear side of an upper end of the moving member 61, and the interlocking member 62 to carry out an up-down motion together with the threading shaft 11 abuts thereon from above.

Furthermore, the moving member 61 includes a plane portion 61*a* obtained by bending a lower part thereof at a right angle and provided along a Y-Z plane, and the thread holding portion 50 is pivotally supported through a support shaft in the X-axis direction at a lower end of the plane portion 61*a*. Moreover, the oscillating lever 63 is pivotally supported by the support shaft which is also provided in the X-axis direction in an upper part of the plane portion 61*a*.

The thread holding portion 50 has the abutting portion 54 on the oscillating lever 63 above the support shaft.

On the other hand, the oscillating lever 63 has the oscillating portion 63*a* suspended downward, and the oscillating portion 63*a* is provided with a projection 63*b*. The projection 63*b* abuts on the abutting portion 54 of the thread holding portion 50 from a rear side. Moreover, the oscillating lever 63 is provided, at an upper rear side thereof, with an engagement extending portion 63*c* on which the thread holding member operating portion 314 of the operation lever 310 abuts from above. When the thread holding member operating portion 314 of the operation lever 310 abuts on the engagement extending portion 63*c* from above, the oscillating portion 63*a* of the oscillating lever 63 is oscillated so that the projection 63*b* presses the abutting portion 54 of the thread holding portion 50 toward a front side to oscillate the thread holding portion 50. By the oscillation, the thread guarding portions 51, 52 provided at the lower end of the thread holding portion 50 can approach the needle 1 to 5 side to transfer the thread to the threading hook 20.

The moving member 61 of the thread holding member support mechanism 60 is downward moved interlockingly with the threading shaft 11 through the interlocking member 62. When the threading shaft 11 is regulated to have a proper height through each of the abutting portions 351-355 of the lower threading guide 350, therefore, the thread holding portion 50 can also be regulated to have a proper height through the moving member 61.

[Selected Needle Indicating Device]

Figure 16:
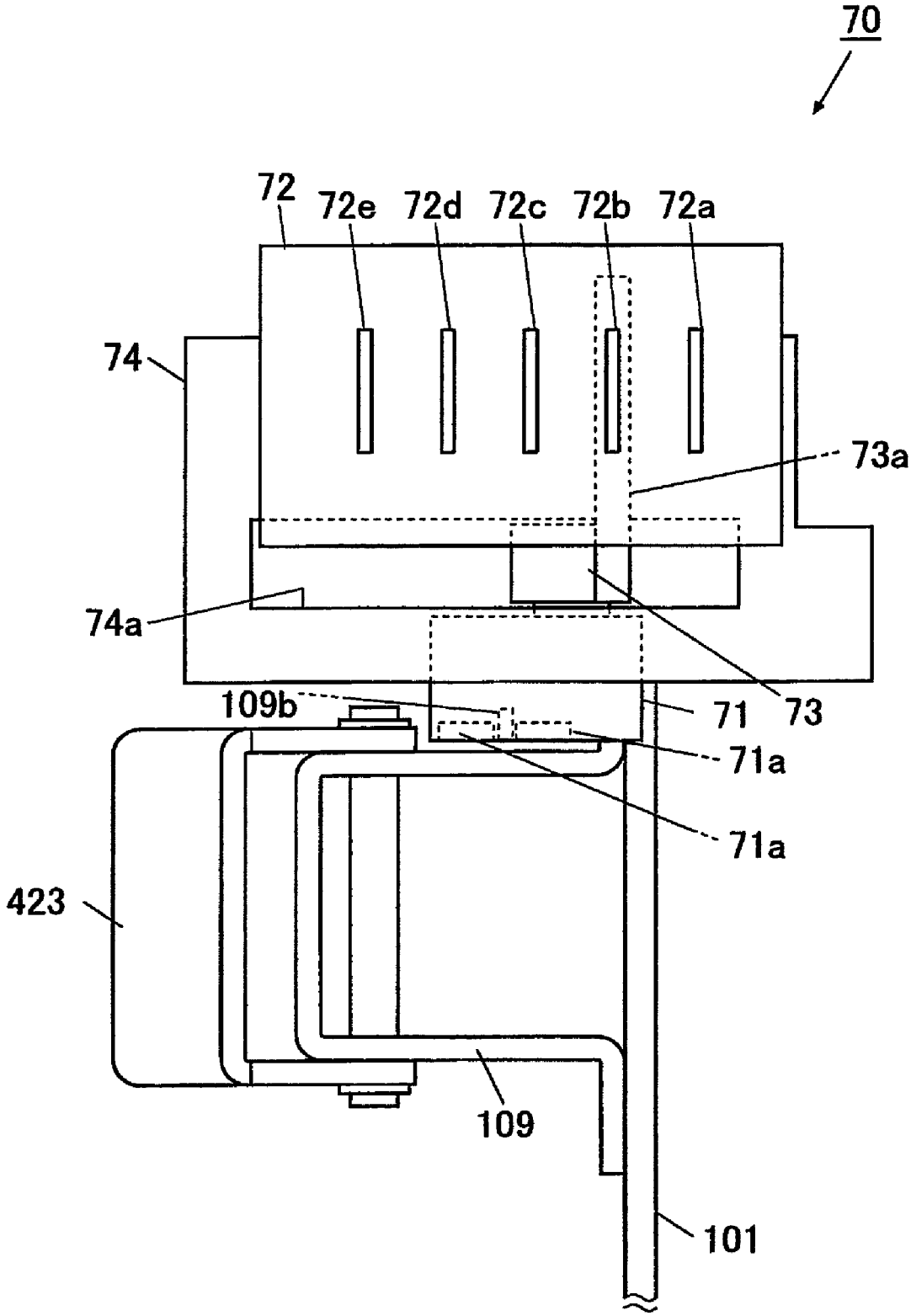
FIG. 16 is a front view of the selected needle indicating device.
Figure 17:
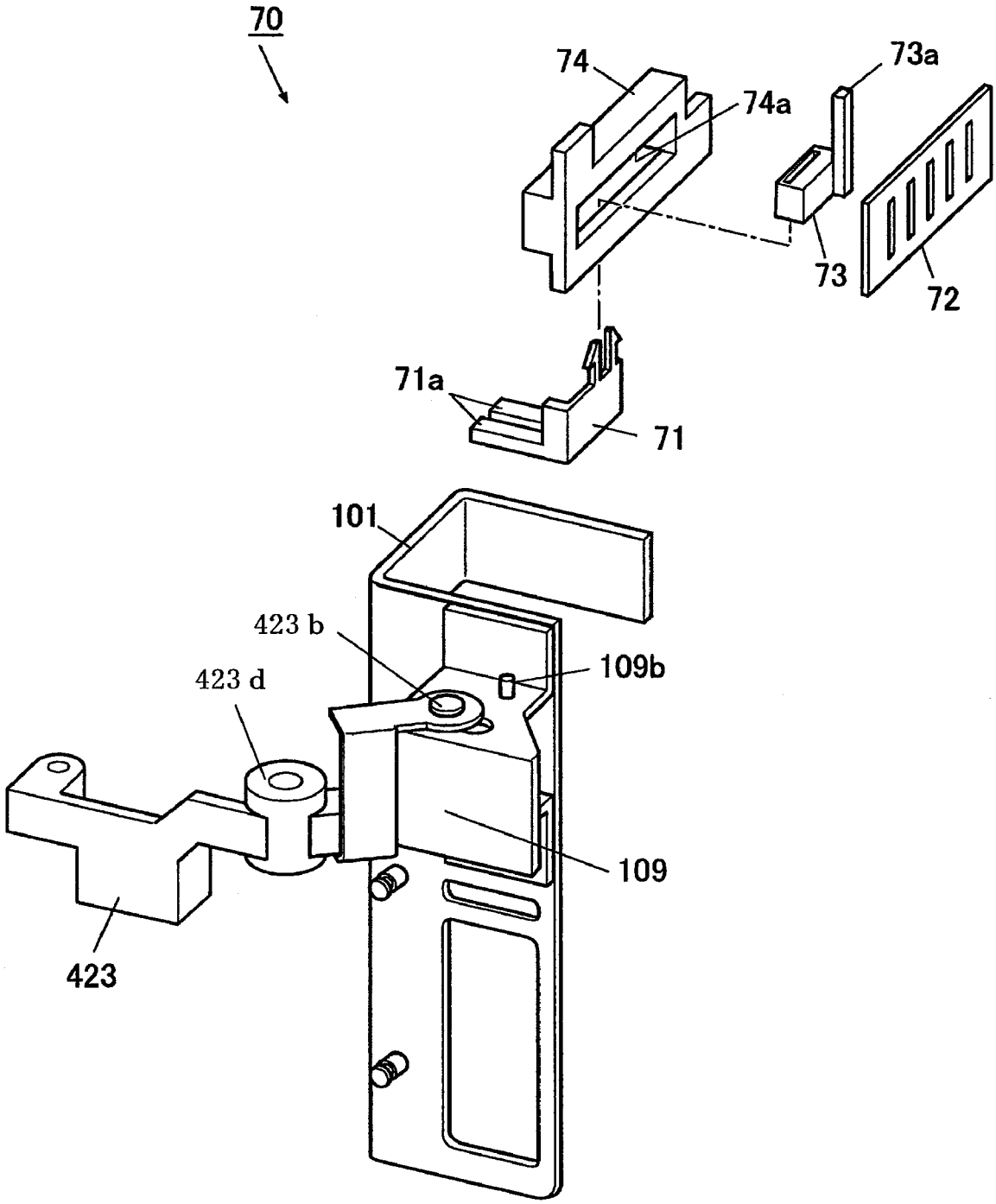
FIG. 17 is an exploded perspective view of the selected needle indicating device.

As shown in FIGS. 16 and 17, the selected needle indicating device 70 includes the indicator moving member 71 to be moved together with the first frame member 101 in only the X-axis direction, a panel 72 (display means) having selection indicating windows 72*a*-72*e* corresponding to the respective needles 1-5, an indicator 73 which is coupled to the indicator moving member 71 and is placed into a position which selectively faces one of the selection indicating windows 72*a*-72*e* from a rear side of the panel 72, and a slide table 74 for reciprocably supporting the indicator 73 in the X-axis direction.

The indicator moving member 71 has the indicator 73 fixed to an upper part thereof and is supported movably in the X-axis direction through the slide table 74 integrally with the indicator 73. The indicator moving member 71 is provided with two coupling arms 71*a* extended in the Y-axis direction. The coupling arms 71*a* have such a structure that they are extended in parallel with each other in a cantilever state and are engaged with each other to interpose the engaging projection 109*b* provided on the bracket 109 of the first frame member 101 therebetween. An interval between the two coupling arms 71*a* is set to be greater than at least an outside diameter of the engaging projection 109*b*, and the engaging projection 109*b* can be smoothly moved in the Y-axis direction between the two coupling arms 71*a*.

The first frame member 101 supports the threading shaft 11 and carries out a movement in the X-axis direction and the Y-axis direction when the needle to perform the threading operation is to be selected. On the other hand, the indicator moving member 71 has such a structure that the engaging projection 109*b* is interposed between the two coupling arms 71*a* extended in the Y-axis direction. When the first frame member 101 is moved, therefore, only the moving operation in the X-axis direction is transmitted to the indicator moving member 71.

All of the needles 1-5 are disposed in different positions in the X-axis direction. When the thread is to be inserted through the needles 1-5, therefore, the indicator moving member 71 is also moved to five fixed positions in the X-axis direction respectively.

The slide table 74 is fixed to a rear face of a cover 12 of the sewing machine. A front face portion is provided with a rectangular opening portion 74*a* in the X-axis direction, and the indicator 73 is fitted in the opening portion 74*a* slidably along the opening portion 74*a*. The opening portion 74*a* penetrates a bottom face side, and the indicator moving member 71 positioned on the bottom face side and the indicator 73 can be coupled to each other.

The indicator 73 has a prismatic bar-shaped portion 73*a* extended in a vertical direction, and a front face of the bar-shaped portion 73*a* is set to have a bright color or a fluorescent color. On the other hand, a front face portion of the slide table 74 is set to have a black color or a dark color and a contrast is given in such a manner that the bar-shaped portion 73*a* of the indicator 73 becomes striking.

Figure 15:
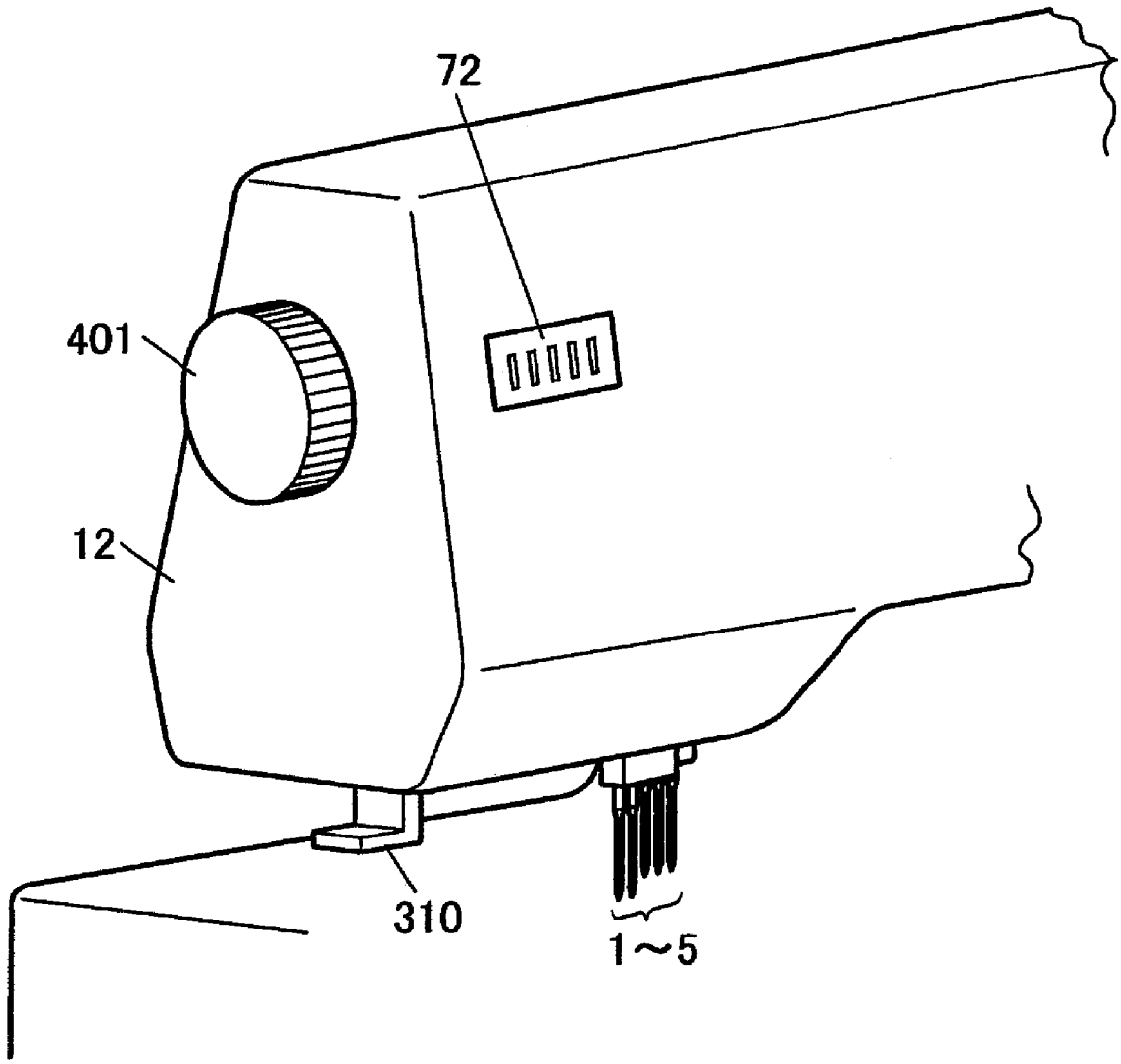
FIG. 15 is a perspective view showing a mounting position of a selected needle indicating device on a sewing machine.

As shown in FIG. 15, the panel 72 is fixed to the surface of the cover 12 of the sewing machine in such a manner that an operator can carry out a visual confirmation from an outside, particularly, a front side of the sewing machine where the operator is placed in the threading work, and is disposed on the front side of the slide table 74. The panel 72 is a square plate and the slit-shaped selection indicating windows 72*a*-72*e* in the vertical direction are formed in a penetration. The selection indicating windows 72*a*-72*e* are provided on the level with the bar-shaped portion 73*a* of the indicator 73. The selection indicating windows 72*a*-72*e* are set into the same positions in the X-axis direction as the bar-shaped portion 73*a* of the indicator 73 when the indicator moving member 71 is moved to the respective fixed positions in the threading operation for the needles 1-5. In other words, when the thread is to be inserted through each of the needles 1-5, the bar-shaped portion 73*a* of the indicator 73 is positioned in one of the five selection indicating windows 72*a*-72*e* in a one-to-one relationship. In the case in which the bar-shaped portion 73*a* of the indicator 73 is positioned in one of the selection indicating windows 72*a*-72*e*, consequently, the bright color or the fluorescent color can be visually recognized through only one of the selection indicating windows and only the black color or dark color of the slide table 72 can be visually recognized through four other selection indicating windows. By confirming one of the selection indicating windows 72*a*-72*e* that has the bright color or the fluorescent color, therefore, it is possible to distinguish the needle selected among the needles 1-5.

Moreover, the panel 72 shows the selected one of the needles 1-5 on the surface (front side) of the cover 12 of the sewing machine. Therefore, the operator of the sewing machine is opposed to the panel 72 so that the indication can be recognized clearly. The surface (front side) of the cover 12 of the sewing machine indicates a surface at an upstream side in a feeding direction of a workpiece.

As shown in FIG. 15, furthermore, the selecting dial 401 is protruded leftward from a left side surface of the cover 12 of the sewing machine and is not present on the same surface as the panel 72 but is disposed behind the panel 72. Therefore, an arm of the operator to manipulate the selecting dial 401 does not disturb the recognition of the panel 72 so that the indication can be recognized clearly.

[Operation of Threading Device]

Description will be given to the threading operation of the threading device 10 having the configuration described above.

First of all, the needles 1-5 for inserting the thread therethrough are selected by the rotating operation of the selecting dial 401.

At this time, the first cam mechanism 420 moves the first frame member 101 of the first support mechanism 100 in the X-axis direction and the second cam mechanism 430 moves the second frame member 201 of the second support mechanism 200 in the Y-axis direction depending on the angular position of the selecting dial 401. By their cooperation, the threading shaft 11 is moved and placed in a predetermined position in the X-Y plane.

At this point, in the height regulating mechanism 330, it is determined as to which of the guide pins 331, 332 abut on which of the abutting portions 351-355.

When the operation lever 310 is manipulated downward, then, the threading shaft 11 starts a downward moving operation together with the threading slide guide 320. Moreover, the moving member 61 is pressed downward by the interlocking member 62 provided on the upper end of the threading shaft 11 so that the thread holding portion 50 also starts the downward moving operation.

When the predetermined guide pins 331, 332 extended from the threading shaft 11 abut on the predetermined abutting portions 351-355, thereafter, the downward moving operation is blocked so that the threading shaft 11 and the threading hook 20 are regulated into the height of the selected needle depending on the set height of the abutting portion. Moreover, the thread holding portion 50 to be interlocked through the interlocking member 62 is also regulated into the height of the selected height.

At this point, when the operation lever 310 is further pressed downward, only the threading slide guide 320 is moved downward with respect to the threading shaft 11. As a result, the threading shaft 11 is rotated clockwise by the action of the threading cam mechanism 340. Moreover, the thread holding member operating portion 314 of the operation lever 310 presses the oscillating portion 63*c* of the oscillating lever 63 from above to rotate the oscillating lever 63. As a result, the threading hook 20 is moved forward and is inserted into the eye of the predetermined needle so that the thread holding portion 50 is tilted toward the needle side to cause the thread stretched in the X-axis direction to approach the front face of the threading hook 20. As a result, the return part of the threading hook 20 catches the thread.

When the operation lever 310 is released from the downward pressing state, then, the threading hook 20 starts the backward movement to pull the caught thread into the eye of the needle so that the threading work is executed.

In the case in which the thread is inserted through the other needles, furthermore, the selecting dial 401 is rotated to downward manipulate the operation lever 310 again.

Figure 18:
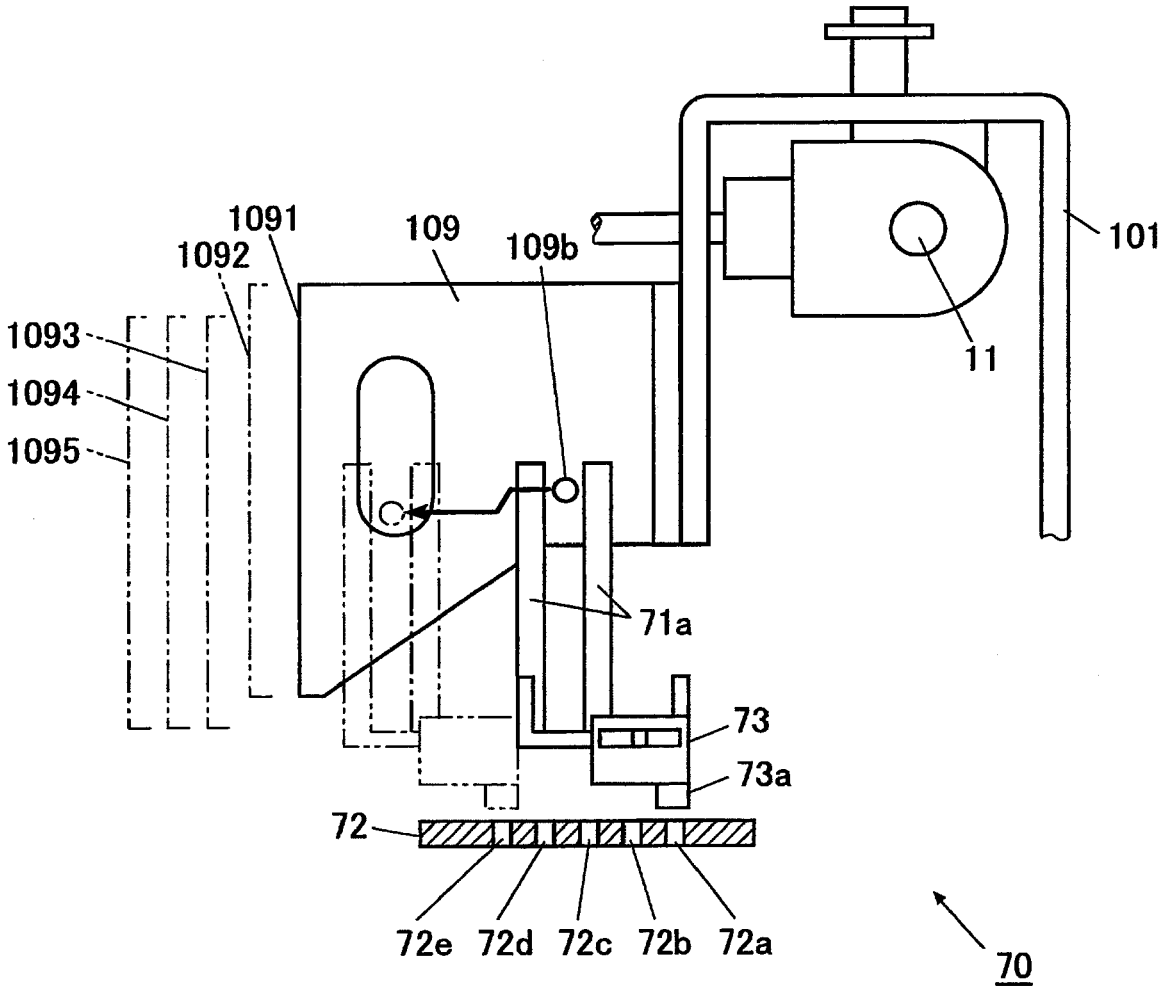
FIG. 18 is an explanatory plan view showing an operation of the selected needle indicating device.

Moreover, the operation of the selected needle indicating device 70 in the case in which the needles 1-5 for carrying out the threading work are selected by the rotating operation of the selecting dial 401 will be described with reference to FIG. 18.

When the thread is to be inserted through each of the needles 1, 2, 3, 4 and 5, the first frame member 101 and the threading shaft 11 are moved in the X-axis direction and the Y-axis direction through the positioning mechanism 400. In FIG. 18, a change in the position of the bracket 109 with the movement to each position is indicated as 1091, 1092, 1093, 1094 and 1095. When the threading shaft 11 is aligned with the needles 1-5 in order, the bracket 109 is changed into five positions in the X-axis direction and is changed into two positions in the Y-axis direction as shown. However, only a displacement in the X-axis direction is transmitted to the indicator moving member 71 and the indicator 73. The bar-shaped portion 73*a* is positioned in the selection indicating window 72*a* when the alignment with the needle 1 is carried out, the bar-shaped portion 73*a* is positioned in the selection indicating window 72*b* when the alignment with the needle 2 is carried out, the bar-shaped portion 73*a* is positioned in the selection indicating window 72*c* when the alignment with the needle 3 is carried out, the bar-shaped portion 73*a* is positioned in the selection indicating window 72*d* when the alignment with the needle 4 is carried out, and the bar-shaped portion 73*a* is positioned in the selection indicating window 72*e* when the alignment with the needle 5 is carried out. Depending on which of the selection indicating windows 72*a*-72*e* is changed to have the bright color or the fluorescent color, accordingly, it is possible to quickly recognize which of the needles 1-5 has been selected.

The threading device 10 supports the threading shaft 11 to be movable to an optional position on the X-Y plane by means of the first support mechanism 100 and the second support mechanism 200, and the positioning mechanism 400 selectively carries out a movement and positioning in the five places corresponding to the needles 1-5 depending on the rotating operation of the selecting dial 401 in cooperation of the two cam mechanisms 420, 430.

As in a sewing machine capable of implementing the overlock stitch and the cover stitch by itself, accordingly, also in the case in which the five needles 1-5 are provided and are not simply arranged in a line, for example, it is possible to position the threading shaft 11 through only the rotating operation of the selecting dial 401 without requiring an individual position adjusting operation in a plurality of directions. In addition, it is also possible to carry out the alignment with all of the needles 1-5 in order. Accordingly, it is possible to precisely insert the thread through all of the needles 1-5.

Moreover, the thread holding portion 50 is provided on the first frame member 101 through the moving member 61. Therefore, the threading shaft 11 as well as the thread holding portion 50 can be aligned with all of the needles 1-5 in order in the X-Y direction through only the rotating operation of the selecting dial 401. Furthermore, it is possible to precisely insert the thread through all of the needles 1-5.

In addition, in the threading device 10, the abutting portions 351-355 of the lower threading guide 350 of the threading mechanism 300 are set to have the heights corresponding to the needles 1-5 individually. Therefore, it is possible to regulate the threading hook 20 to have a proper height with respect to the eye of each of the needles 1-5.

Also in the case in which the five needles 1-5 are provided as in the sewing machine capable of implementing the overlock stitch and the cover stitch by itself, two guide pins 331, 332 are provided. Therefore, it is possible to distribute and provide the abutting portions 351-355 on the lower threading guide 350 and to properly regulate the height of the threading hook 20, thereby causing the threading work to be more appropriate.

Since the selected needle indicating device 70 is provided, moreover, it is possible to indicate one of the needles 1-5 with which the threading shaft 11 is aligned distinguishably from the other needles when carrying out the alignment in accordance with the manipulation of the selecting dial 401. Differently from the case in which the position of the threading shaft 11 is visually confirmed, accordingly, it is possible to accurately grasp the selected needles 1-5. Furthermore, it is not necessary to carry out an operation for rotating the threading shaft 11 in the confirmation. Therefore, it is possible to eliminate the complicatedness of the confirming work.

Moreover, the selected needle indicating device 70 indicates one of the needles 1-5 with respect to which the threading shaft 11 is positioned in accordance with a change in the positions of the indicator moving member 71 and the indicator 73 which are moved together with the threading shaft 11. Therefore, it is not necessary to provide means for electrically detecting the position of the threading shaft 11 and means for displaying information about the position and it is possible to confirm the selected needle with a simple structure.

Second Exemplary Embodiment

Although the selecting dial 401 (the selecting portion) is protruded leftward from the left side surface of the cover 12 of the sewing machine in the threading device 10 of the first exemplary embodiment, the present invention is not restricted to such an arrangement. Hereinafter, a second exemplary embodiment in which a selecting portion and an arrangement thereof are different from the first exemplary embodiment will be described with reference to FIGS. 19 to 22. In the second exemplary embodiment, the same structures as those of the threading device 10 of the first exemplary embodiment have the same reference numerals and description thereof will be omitted.

Figure 19:
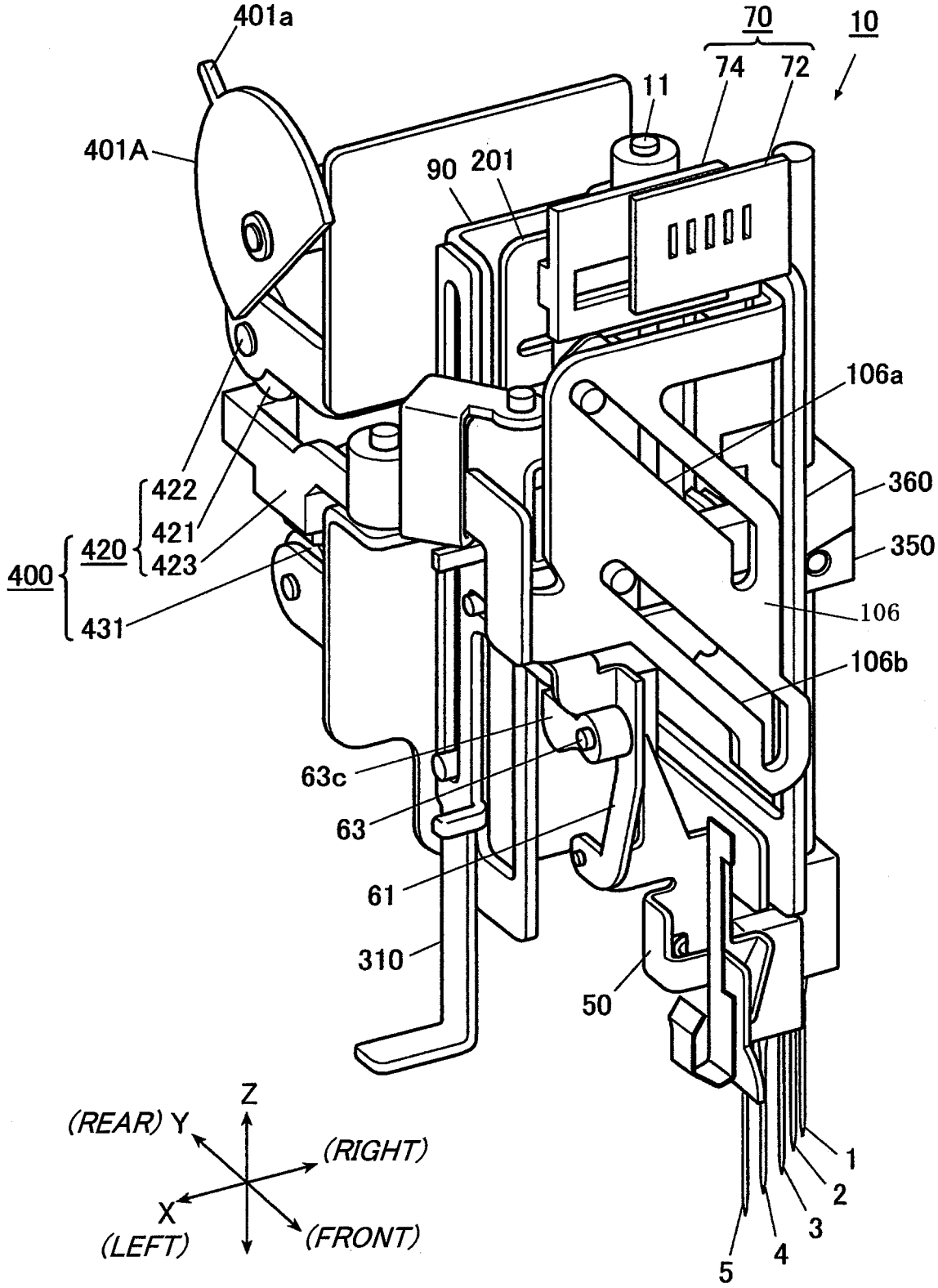
FIG. 19 is a perspective view of a threading device having a selecting portion according to a second exemplary embodiment.

The second exemplary embodiment is different from the first exemplary embodiment in that, instead of the circular selecting dial 401 provided on the rotating support shaft 422 of the first exemplary embodiment, a third rotating support shaft 418A is provided above the rotating support shaft 422 and a selecting lever 401A (a selecting portion) is provided on the third rotating support shaft 418A as shown in FIG. 19.

Figure 20:
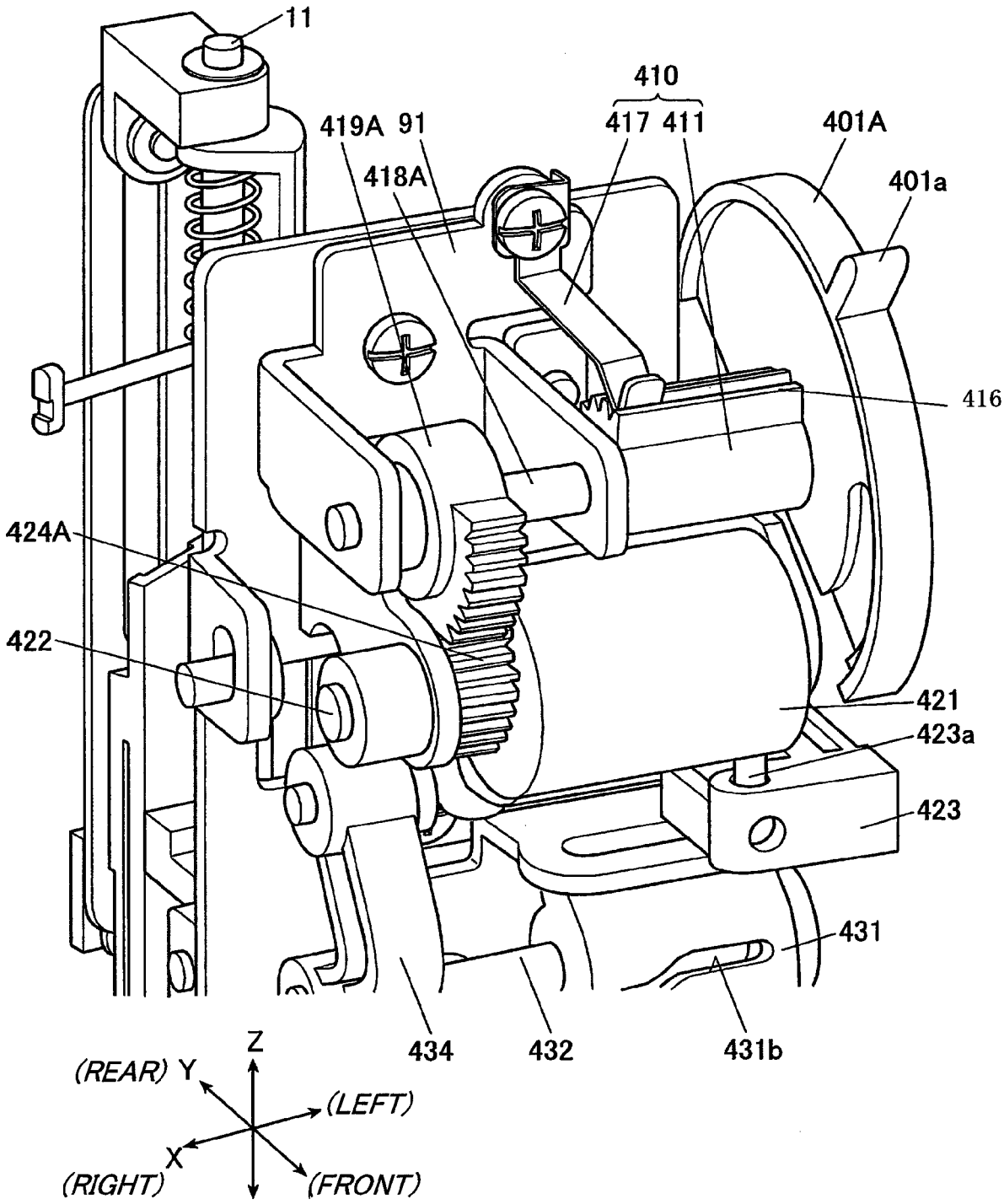
FIG. 20 is another perspective view of a portion of the threading device of FIG. 19.
Figure 21:
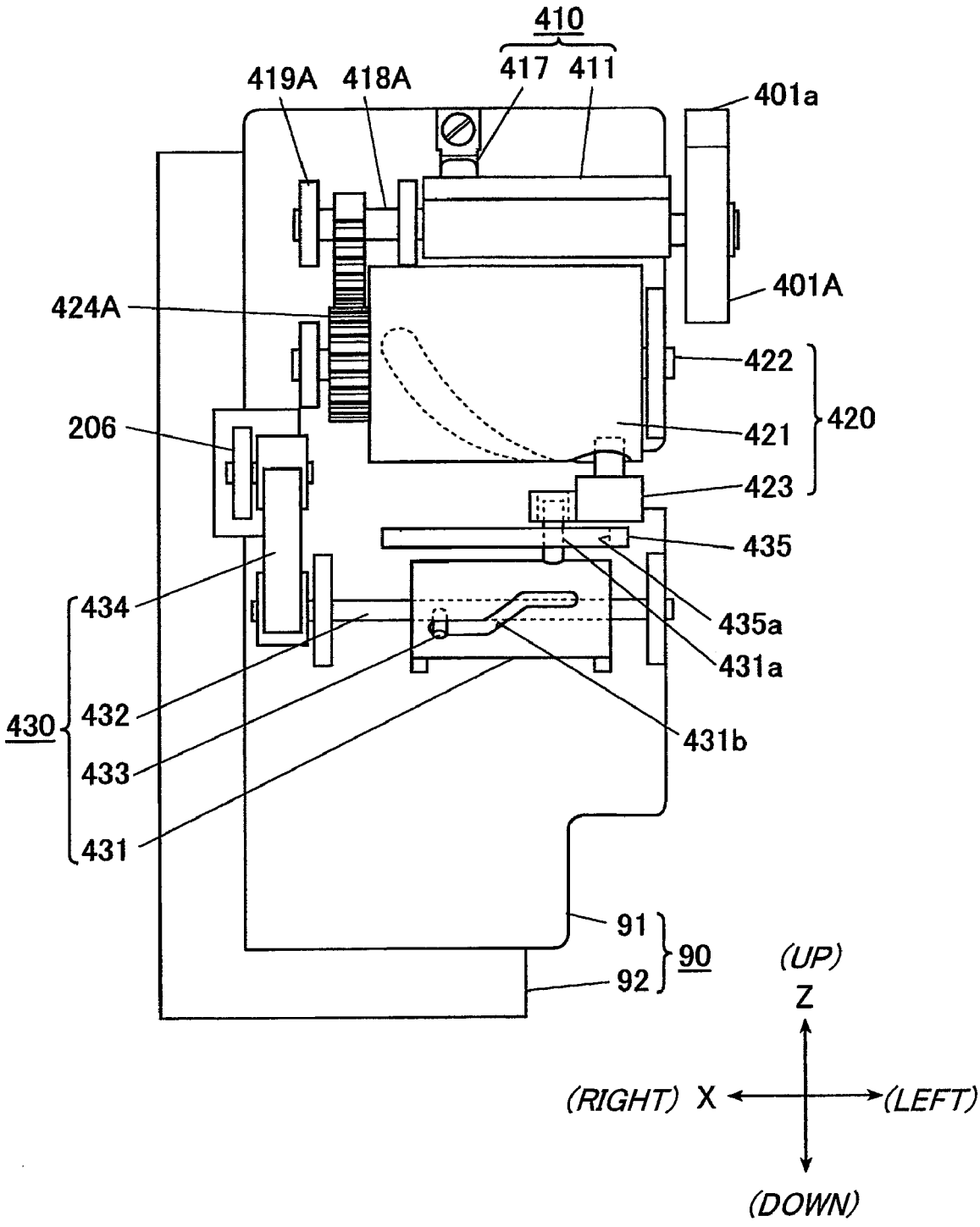
FIG. 21 is a rear view of the threading device of FIG. 19.

More specifically, as shown in FIGS. 20 and 21, the third rotating support shaft 418A is supported rotatably by a back plate 91 in the X-axis direction above the rotating support shaft 422 at a rear side of the back plate 91, and the selecting lever 401A is fixed to one end (a left end) thereof.

The selecting operation switching lever 401A includes a lever portion 401*a* extended like a bar outward in a radial direction of a disk which is partially cut away linearly, and is fixed to the third rotating support shaft 418A in a central position of the disk.

Furthermore, a main driving gear 419A is fixed to the other end (a right end) of the third rotating support shaft 418A and is engaged with a driven gear 424A which is newly provided on the rotating support shaft 422. The driven gear 424A is fixed to the rotating support shaft 422. When a rotating operation is applied to the selecting lever 401A, the driven gear 424A is rotated through the third rotating support shaft 418A and the main driving gear 419A, and furthermore, a first cam 421 is also rotated. Subsequent operations are the same as those of the first exemplary embodiment.

Moreover, the stage switching portion 410 is moved to an intermediate position between the rotating support shaft 422 and the third rotating support shaft 418A.

Figure 22:
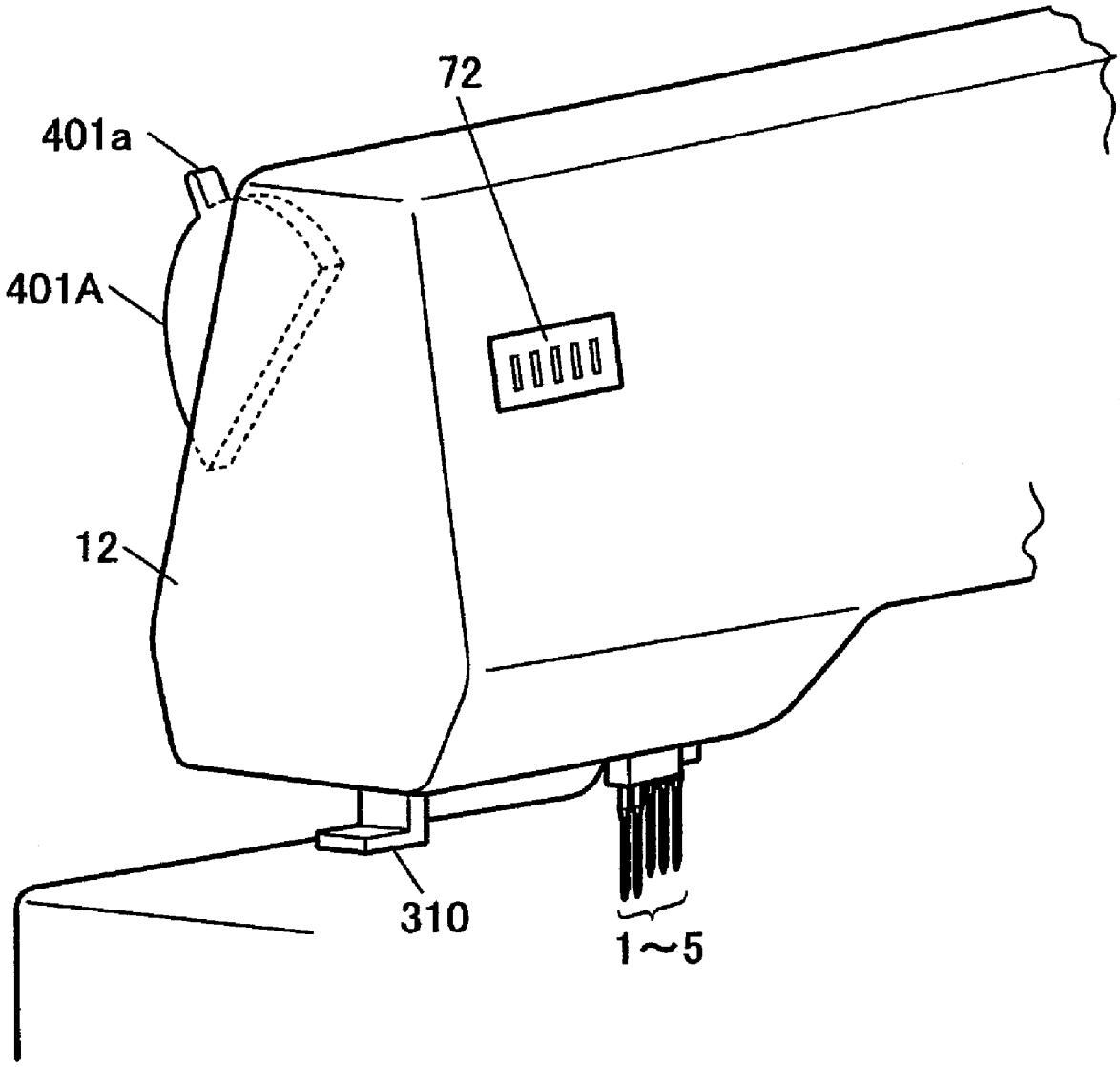
FIG. 22 is a perspective view showing a mounting position of the threading device of FIG. 19 on a sewing machine.

By employing the structure, it is possible to dispose the selecting operation switching lever 401A rightward and rearward (the rear side) as compared with the selecting dial 401 and to provide the lever portion 401*a* so as to be protruded from the rear side (the rear side) of the sewing machine cover 12 as shown in FIG. 22.

Consequently, the selecting lever 401A is disposed on a surface at an opposite side to the indicating position of the panel 72 in the selected needle indicating device 70 in the cover 12. As compared with the selecting dial 401, therefore, it is possible to more effectively avoid a problem in that the arm of the operator for executing the operation for selecting the needles 1-5 to carry out the threading work causes the indication of the selected needle positioned on the front side of the sewing machine to be shielded or seen with difficulty in the same operation, to confirm the selection of the needle more satisfactorily, and to avoid a selection error and to further enhance a workability.

Other Exemplary Embodiments

The selected needle indicating device 70 may be provided with a sensor for detecting a change in a position for the threading shaft 11 or a structure to be displaced in the X-axis direction together with the threading shaft 11 and may be provided with a panel for displaying which of the needles 1-5 has been selected upon receipt of a signal sent from the sensor. For example, by utilizing a linear scale for detecting a linear moving amount to couple the sensor to the first frame member 101 in the same structure as the indicator moving member 71, it is possible to detect a position of the threading shaft 11 which corresponds to one of the needles in the X-axis direction. By utilizing a liquid crystal panel to display the needle selected corresponding to a result of the detection, for example, it is possible to quickly recognize the selected needle.

Consequently, it is possible to decrease a mechanical movable structure and to enhance durability without an influence of deterioration such as an abrasion.

Moreover, the selected needle indicating device 70 may have such a structure that the needle 1-5 with respect to which the threading shaft 11 is positioned is indicated with a light emission. For example, it is possible to easily implement the same structure by attaching a light emitting device to the bar-shaped portion 73*a* of the indicator 73 or utilizing the panel 72 in the example which is of a light emitting display type.

Consequently, it is possible to distinguish the selected needles 1-5 more accurately and immediately.

While description has been made in connection with exemplary embodiments of the present invention, those skilled in the art will understand that various changes and modification may be made therein without departing from the present invention. It is aimed, therefore, to cover in the appended claims all such changes and modifications falling within the true spirit and scope of the present invention.

What is claimed is:

1. A threading device of a sewing machine having a plurality of needles, the threading device being configured to insert a thread through an eye of any one of the needles, the threading device comprising:

a threading hook which moves forward to enter the eye of one of the needles and moves backward to catch the thread and to insert the thread through the eye;

a threading mechanism which moves the threading hook to insert the thread;

a selecting portion operable to select, among the plurality of needles, a needle through which the thread is to be inserted;

a positioning mechanism which moves the threading hook to a position corresponding to the needle selected by operating the selecting portion; and a selected needle indicating device which distinguishably indicates the needle with respect to which the threading hook has been positioned by operating the selecting portion.

2. The threading device according to claim 1, wherein the selected needle indicating device comprises an indicator which moves together with the threading hook, wherein the selected needle indicating device indicates, in accordance with a position of the indicator, the needle with respect to which the threading hook has been positioned.

3. The threading device according to claim 1, wherein the selected needle indicating device comprises:

position detecting means for detecting a position of the threading hook; and display means for indicating the needle corresponding to the position detected by the position detecting means.

4. The threading device according to claim 1, wherein the selected needle indicating device emits light to indicate the needle with respect to which the threading hook has been positioned.

5. The threading device according to claim 1, wherein the selected needle indicating device indicates, at a front side portion of the sewing machine, the needle with respect to which the threading hook has been positioned.

6. The threading device according to claim 5, wherein the selecting portion is disposed on a rear side of an indicating position of the selected needle indicating device.

7. A threading device of a sewing machine having a plurality of needles arranged along a direction intersecting a cloth feeding direction, the threading device being configured to selectively insert a thread through an eye of one of the needles, the threading device comprising:

a threading hook which is supported on a sewing machine arm so as to be rotatable around a vertical axis and movable along an axial direction of the vertical axis, wherein the threading hook is rotatable, at a downwardly moved position which is coincident with the eye of one of the needles, between a forwardly moved position toward which the threading hook enters the eye and a backwardly moved position toward which the threading hook catches and inserts the thread through the eye;

a threading mechanism coupled to the threading hook to rotate the threading hook between the backwardly moved position and the forwardly moved position;

a selecting portion operable from an outside of the sewing machine to select a needle through which the thread is to be inserted;

a positioning mechanism coupled to the threading hook to move the threading hook, interlockingly with the selecting portion, in the direction along which the plurality of needles are arranged to a position corresponding to the selected needle; and a selected needle indicating device comprising an indicator which is disposed so as to be visible from the outside of the sewing machine, wherein the indicator is configured to interlock with a movement of the threading hook in the direction along which the plurality of needles are arranged.

* * * * *